US005748480A

United States Patent [19]

Mizuno

[11] Patent Number: 5,748,480

[45] Date of Patent: May 5, 1998

[54] EMBROIDERY DATA PROCESSING APPARATUS

[75] Inventor: Masahiro Mizuno, Nagoya, Japan

[73] Assignee: Brother Kogyo Kabushiki Kaisha, Nagoya, Japan

[21] Appl. No.: 680,775

[22] Filed: Jul. 16, 1996

[30] Foreign Application Priority Data

Jul. 21, 1995 [JP] Japan ..... 7-185672

[51] Int. Cl.[6] ..... D05C 7/66; G06F 19/00; G06G 7/66

[52] U.S. Cl. ..... 364/470.09; 112/102.03; 112/102.05; 112/103; 112/470.09; 112/470.06; 112/470.07

[58] Field of Search ..... 364/420.09; 112/102.05, 112/103, 470.09, 470.06

[56] References Cited

U.S. PATENT DOCUMENTS

| | | | |
|---|---|---|---|
| 4,413,574 | 11/1983 | Hirota et al. | 112/470.04 |
| 4,825,784 | 5/1989 | Nomoto | 112/103 |
| 5,189,623 | 2/1993 | Komuru et al. | 364/470.09 |
| 5,227,976 | 7/1993 | Hayakawa | 364/470 |
| 5,231,586 | 7/1993 | Shimizu | 364/470.09 |
| 5,343,401 | 8/1994 | Goldberg et al. | 364/470.09 |
| 5,422,819 | 6/1995 | Nakamura et al. | 364/470.09 |
| 5,474,000 | 12/1995 | Mizuno et al. | 112/102.05 |
| 5,537,945 | 7/1996 | Sugihara et al. | 112/470.06 |
| 5,563,795 | 10/1996 | Futamura et al. | 364/470.09 |

*Primary Examiner*—Reba I. Elmore
*Assistant Examiner*—McDieunel L. Marc
*Attorney, Agent, or Firm*—Oliff & Berridge, PLC

[57] ABSTRACT

A system for processing embroidery data which are used to control a sewing machine to form stitches filling an embroidery area and thereby produce an embroidery on at least one work sheet, the system including an outline-data obtaining device which obtains a plurality of sets of outline data each set of which defines a corresponding one of a plurality of outlines including a first outline and one or more second outlines positioned inside the first outline, an attribute-data obtaining device which obtains, in connection with each of the outlines, a set of attribute data including objective-area specifying data specifying an objective area bounded by the each outline, and embroidery-area specifying device for specifying, as the embroidery area, an objective area bounded by at least one of the outlines.

39 Claims, 13 Drawing Sheets

EMBROIDERY DATA PROCESSING APPARATUS

BACKGROUND OF THE INVENTION

1. Field of the Invention

The present invention relates to an apparatus for processing embroidery data which are used to control a sewing machine to form stitches filling an embroidery area and thereby produce an embroidery on one or more work sheets.

2. Related Art Statement

Embroidery data used for producing an embroidery may be provided by x and y coordinates of stitch positions at each of which a needle of a sewing machine penetrates a work sheet. Conventionally, those stitch positions had been determined by a skilled worker. Recently, however, a sewing machine, industrial or domestic, is highly required to have the function of sewing embroideries, because the demand for embroideries has increased. Hence, an embroidery-data processing apparatus may be used to produce embroidery data automatically to some extent.

For example, there is known a method of processing embroidery data for forming stitches filling a closed area bounded by an outline, such that the stitches extend in an appropriate direction. This method may be carried out by a prior embroidery-data processing apparatus.

In addition, there has been proposed a method of processing embroidery data for forming stitches filling an enclosed, the term "doughnut-like" is used throughout the remainder of the specification as FIG. 4 provides an exemplary embroidery pattern and the areas enclosed by the lines, except the center, have a doughnut or ring-like appearance as viewed, bounded by a first outline and a second outline contained or positioned inside the first outline. Each of the first and second outlines defines a closed inside area bounded by itself. For example, there is known an apparatus which automatically processes embroidery data for sewing a doughnut-like embroidery area, in response to user's designation of a pair of inner and outer outlines which cooperate with each other to define the doughnut-like area. Japanese Patent Application laid open for inspection purposes under Publication No. 1(1989)-305987 discloses a method of processing embroidery data for sewing a doughnut-like embroidery area.

However, the above-indicated embroidery-data processing apparatus or method is incapable of providing, in a single processing sequence, a plurality of batches of embroidery data for sewing a plurality of doughnut-like embroidery areas defined by three or more outlines as shown in FIG. 4. Regarding the example shown in FIG. 4, the prior apparatus or method cannot provide, in a single processing sequence, two batches of embroidery data for sewing two doughnut-like closed areas, A and B.

In the case where the prior embroidery-data processing apparatus is used to process two batches of embroidery data for two doughnut-like embroidery areas A, and B, first, a user is required to designate a pair of outer and inner outlines (i.e., outlines, L1 and L2) defining an outer doughnut-like area (i.e., area A), so that the processing apparatus processes a batch of embroidery data for the outer doughnut-like area, and then the user designates a pair of outer and inner outlines (i.e., outlines, L2 and L3) defining an inner doughnut-like area (i.e., area B), so that the processing apparatus processes another batch of embroidery data for the inner doughnut-like area. According to this technique, the user is required to designate an increased number of pairs of inner and outer outlines, as the number, n, of the outlines, Ln, increases. Accordingly, the time needed to process the embroidery data increases.

Meanwhile, there is known another embroidery-data processing apparatus including an image reader, such as an image scanner, which reads an original image from an original and produces image data representing the read image. The second processing apparatus produces embroidery data by processing the image data. In this case, a user is required to draw, on a sheet, an original image, such as the outlines L1 to L3 shown in FIG. 4, and to operate the image scanner to read the original image from the original-image bearing sheet. The second processing apparatus produces, in a single processing sequence, two batches of embroidery data for the two doughnut-like areas A, B.

However, in the case where the second processing apparatus is used to produce three batches of embroidery data for forming stitches filling an entire inside (closed) area defined by each of the three outlines L1 to L3 such that the embroidery formed in the entire area A-B-C defined by the outline L1 underlies the embroidery formed in the entire area B-C defined by the outline L2 and the embroidery formed in the entire area C defined by the outline L3 overlies the embroidery formed in the entire area B–C, the user is required to prepare three original sheets separate from each other such that the three sheets bear the three outlines L1 to L3, respectively, and to operate the image scanner to read the outlines L1 to L3 on the respective originals, one after another. Accordingly, as the number n of the outlines Ln increases, the user is required to prepare an increased number of originals and operate the image scanner by an increased number of times. Thus, the time consumed to produce embroidery data increases.

SUMMARY OF THE INVENTION

It is therefore an object of the present invention to provide an embroidery data processing apparatus which obtains a plurality of sets of outline data respectively defining a plurality of outlines comprising a first outline and one or more second outline positioned inside the first outline and also obtains, in connection with each of the outlines, a set of attribute data indicating whether a part or an entirety of an inside and/or outside area defined by each outline is embroidered or not.

The above object has been achieved by the present invention. According to a first aspect of the present invention, there is provided a system for processing embroidery data which are used to control a sewing machine to form stitches filling an embroidery area and thereby produce an embroidery on at least one work sheet, the system comprising an outline-data obtaining device which obtains a plurality of sets of outline data each set of which defines a corresponding one of a plurality of outlines comprising a first outline and at least one second outline positioned inside the first outline, and an attribute-data obtaining device which obtains, in connection with each of the outlines, a set of attribute data which indicates at least one of an inside-area embroidery command to produce a batch of inside-area embroidery data to form the stitches filling, as the embroidery area, at least a part of an inside area of the each outline, and a part-outside-area embroidery command to produce a batch of part-outside-area embroidery data to form the stitches filling, as the embroidery area, a part of an outside area of the each outline. In the case where two or more second outlines are positioned inside the first outline, one second outline may be positioned inside another or the other second outline, or positioned such that an inside area defined by the one second outline does not overlap that defined by another or the other second outline.

In the embroidery-data processing apparatus constructed as described above, a user may input, in connection with each of the outlines, a set of attribute data indicating an inside-area embroidery command and/or a part-outside-area embroidery command. The attribute-data obtaining device obtains the thus input sets of attribute data, which are used with the sets of outline data obtained by the outline-data obtaining device, to specify embroidery areas and process batches of embroidery data for forming stitches filling the specified embroidery areas. Thus, the present processing system can process, in a single processing sequence, two or more batches of embroidery data for two or more embroidery areas.

According to a preferred feature of the first aspect of the invention, the attribute-data obtaining device comprises a first obtaining process for obtaining, in connection with the each outline, the set of attribute data which selectively indicates, as the inside-area embroidery command, one of an entire-inside-area embroidery command to produce, as the inside-area embroidery data, a batch of entire-inside-area embroidery data to form the stitches filling, as the embroidery area, an entirety of the inside area of the each outline, and a part-inside-area embroidery command to produce, as the inside-area embroidery data, a batch of part-inside-area embroidery data to form the stitches filling, as the embroidery area, the part of the inside area of the each outline.

According to another feature of the first aspect of the invention, the processing system further comprises an embroidery-area specifying process for specifying, as the embroidery area, the entirety of the inside area of the each outline, when the first obtaining process of the attribute-data obtaining device obtains, in connection with the each outline, the set of attribute data indicating the entire-inside-area embroidery command.

According to another feature of the first aspect of the invention, the attribute-data obtaining device further comprises second obtaining means for obtaining, in connection with at least one of the outlines, the set of attribute data indicating the part-outside-area embroidery command to produce the batch of part-outside-area embroidery data.

According to another feature of the first aspect of the invention, the processing system further comprises an embroidery-area specifying process for specifying, as the embroidery area, the part of the inside area of the each outline, when the first obtaining process obtains, in connection with the each outline, the set of attribute data indicating the part-inside-area embroidery command and the second obtaining process of the attribute-data obtaining device obtains the set of attribute data indicating the part-outside-area embroidery command, in connection with at least one of the outlines which is positioned inside the each outline. Alternatively, the embroidery-area specifying process may specify, as the embroidery area, the part of the outside area of the each outline, when the second obtaining process obtains, in connection with the each outline, the set of attribute data indicating the part-outside-area embroidery command and the first obtaining process obtains the set of attribute data indicating the part-inside-area embroidery command, in connection with at least one of the outlines which is positioned outside the each outline.

According to another feature of the first aspect of the invention, the embroidery-area specifying process specifies, as the embroidery area, the part of the inside area of the each outline which is defined by the each outline and an outermost one of all inside outlines each of which is positioned inside the each outline and is connected with the part-outside-area embroidery command obtained by the second obtaining process, the outermost inside outline being positioned outside of each of the other inside outlines. Alternatively, the embroidery-area specifying process may comprise means for specifying, as the embroidery area, the part of the outside area of the each outline which is defined by the each outline and an innermost one of all outside outlines each of which is positioned outside the each outline and is connected with the part-inside-area embroidery command obtained by the first obtaining process, the innermost outside outline being positioned inside of each of the other outside outlines. In either case, a doughnut-like area is specified as an embroidery area.

According to another feature of the first aspect of the invention, the processing system further comprises an embroidery-area specifying process for specifying, as the embroidery area, the entirety of the inside area of the each outline, when the first obtaining process of the attribute-data obtaining device obtains, in connection with the each outline, the set of attribute data indicating the part-inside-area embroidery command and the second obtaining process of the attribute-data obtaining device does not obtain the set of attribute data indicating the part-outside-area embroidery command, in connection with any of the outlines which is positioned inside the each outline.

According to another feature of the first aspect of the invention, the processing system further comprises an embroidery-area specifying process for specifying, as the embroidery area, the part of the inside area of the each outline which is defined by the each outline and one of all inside outlines positioned inside the each outline, the one inside outline being apart inward from the each outline with a predetermined number of the inside outlines being positioned between the each outline and the one inside outline. The predetermined number may be zero, one, two, etc.

According to another feature of the first aspect of the invention, the processing system further comprises an embroidery-data producing process for producing, as the embroidery data, at least one of a set of embroidery-area data which defines, as the embroidery area, at least one of the at least part of the inside area of the each outline and the part of the outside area of the each outline, and a plurality of sets of stitch-position data each set of which defines a corresponding one of a plurality of stitch positions where a sewing needle of the sewing machine penetrates the work sheet to form a corresponding one of the stitches filling, as the embroidery area, at least one of the at least part of the inside area of the each outline and the part of the outside area of the each outline. The embroidery-data producing process may be provided by a personal computer, or a control device of the sewing machine.

According to a second aspect of the present invention, there is provided a system for processing embroidery data which are used to control a sewing machine to form stitches filling an embroidery area and thereby produce an embroidery on at least one work sheet, the system comprising an outline-data obtaining device which obtains a plurality of sets of outline data each set of which defines a corresponding one of a plurality of outlines comprising a first outline and at least one second outline positioned inside the first outline, and an attribute-data obtaining device which selectively obtains, in connection with each of the outlines, one of a set of sewing attribute data which indicates at least one of an inside-area embroidery command to produce a batch of inside-area embroidery data to form the stitches filling, as the embroidery area, at least a part of an inside area defined by the each outline, and a part-outside-area embroidery command to produce a batch of part-outside-area embroidery data to form the stitches filling, as the embroidery area, a part of an outside area defined by the each outline, and a set of non-sewing attribute data which indicates a non-embroidery command not to produce any embroidery data to form any stitches filling any of the at least part of the inside area defined by the each outline and the part of the outside area defined by the each outline.

The embroidery-data processing system in accordance with the second aspect of the invention enjoys the same advantages as those of the processing system in accordance with the first aspect of the invention. In addition, a user may input, in connection with at least one of the outlines, a batch of attribute data indicating a non-embroidery command. Accordingly, a doughnut-like area may be specified as a non-embroidery area.

According to a preferred feature of the second aspect of the invention, the attribute-data obtaining device comprises a first obtaining process for obtaining, in connection with at least one of the outlines, the set of sewing attribute data which selectively indicates, as the inside-area embroidery command, one of an entire-inside-area embroidery command to produce, as the inside-area embroidery data, a batch of entire-inside-area embroidery data to form the stitches filling, as the embroidery area, an entirety of the inside area of the one outline, and a part-inside-area embroidery command to produce, as the inside-area embroidery data, a batch of part-inside-area embroidery data to form the stitches filling, as the embroidery area, the part of the inside area of the one outline.

According to another feature of the second aspect of the invention, the processing system further comprises an embroidery-area specifying process for specifying, as the embroidery area, the entirety of the inside area of the one outline, when the first obtaining process of the attribute-data obtaining device obtains, in connection with the one outline, the set of sewing attribute data indicating the entire-inside-area embroidery command.

According to another feature of the second aspect of the invention, the attribute-data obtaining device further comprises a second obtaining process for obtaining, in connection with at least one of the outlines, the set of sewing attribute data indicating the part-outside-area embroidery command to produce the batch of part-outside-area embroidery data.

According to another feature of the second aspect of the invention, the processing system further comprises an embroidery-area specifying process for specifying, as the embroidery area, the part of the inside area of the one outline, when the first obtaining process of the attribute-data obtaining device obtains, in connection with the one outline, the set of sewing attribute data indicating the part-inside-area embroidery command and the second obtaining means of the attribute-data obtaining device obtains the set of attribute data indicating the part-outside-area embroidery command, in connection with at least one of the outlines which is positioned inside the one outline.

According to another feature of the second aspect of the invention, the embroidery-area specifying process comprises means for specifying, as the embroidery area, the part of the inside area of the one outline which is defined by the one outline and an outermost one of all inside outlines each of which is positioned inside the one outline and is connected with the part-outside-area embroidery command obtained by the second obtaining process, the outermost inside outline being positioned outside of each of the other inside outlines.

According to another feature of the second aspect of the invention, the embroidery-area specifying process process specifies, as the embroidery area, the entirety of the inside area of the one outline, when the first obtaining process of the attribute-data obtaining device obtains, in connection with the one outline, the set of attribute data indicating the part-inside-area embroidery command and the second obtaining process of the attribute-data obtaining device does not obtain the set of attribute data indicating the part-outside-area embroidery command, in connection with any of the outlines which is positioned inside the one outline.

According to another feature of the second aspect of the invention, the processing system further comprises an embroidery-area specifying process for specifying, as the embroidery area, the part of the inside area of the one outline which is defined by the one outline and one of all inside outlines positioned inside the one outline, the one of the all inside outlines being apart inward from the one outline with a predetermined number of the inside outlines being positioned between the one outline and the one of the all inside outlines.

According to another feature of the second aspect of the invention, the processing system further comprises an embroidery-data producing process for producing, as the embroidery data, at least one of a set of embroidery-area data which defines, as the embroidery area, at least one of the at least part of the inside area of at least one of the outlines and the part of the outside area of the one outline, and a plurality of sets of stitch-position data each set of which define a corresponding one of a plurality of stitch positions where a sewing needle of the sewing machine penetrates the work sheet to form a corresponding one of the stitches filling, as the embroidery area, at least one of the at least part of the inside area of at least one of the outlines and the part of the outside area of the one outline.

According to another feature of the second aspect of the invention, the embroidery-data producing process comprises a computer.

According to another feature of the second aspect of the invention, the computer comprises a connector which is adapted to be connected to the sewing machine via a communication line.

According to another feature of the second aspect of the invention, the computer comprises a control device which is incorporated into the sewing machine to control a sewing operation of the sewing machine.

According to another feature of the second aspect of the invention, the outline-data obtaining device comprises a command input device which is operable by a user for inputting a outline-data producing command, an outline-data producing device which produces at least one of the sets of outline data based on the outline-data producing command input through the input device, and a memory which stores the one set of outline data produced by the outline-data producing device.

According to another feature of the second aspect of the invention, the command input device comprises a display and at least one of a keyboard and a pointing device such as a mouse, and wherein the outline-data producing device comprises a computer which is connected to the display and the one of the keyboard and the pointing device.

According to another feature of the second aspect of the invention, the outline-data obtaining device comprises a reading device which reads at least one of the sets of outline data from an external memory, such as a floppy disk, which is settable in, and removable from, the reading device and in which the one set of outline data is stored.

According to another feature of the second aspect of the invention, the the attribute-data obtaining device comprises a data input device which is operable by a user for inputting the one of the set of sewing attribute data and the set of non-sewing attribute data, in connection with the each outline, and a memory which stores the one of the set of sewing attribute data and the set of non-sewing attribute data input through the data input device.

According to a third aspect of the present invention, there is provided a system for processing embroidery data which are used to control a sewing machine to form stitches filling an embroidery area and thereby produce an embroidery on at least one work sheet, the system comprising an outline-data obtaining device which obtains a plurality of sets of outline data each set of which defines a corresponding one of a plurality of outlines comprising a first outline and at least one second outline positioned inside the first outline, an attribute-data obtaining device which obtains, in connection with each of the outlines, a set of attribute data comprising objective-area specifying data specifying an objective area bounded by the each outline, and an embroidery-area specifying process for specifying, as the embroidery area, an objective area bounded by at least one of the outlines.

The embroidery-data processing system in accordance with the third aspect of the invention enjoys the same advantages as those of the processing system in accordance with the first aspect of the invention.

According to a preferred feature of the third aspect of the invention, the attribute-data obtaining device obtains, in connection with the each outline, the set of attribute data comprising the objective-area specifying data including outer-outline data indicating whether the each outline provides an outer outline which cooperates with one of the outlines positioned inside the each outline, to specify the objective area bounded by the each outline, and inner-outline data indicating whether the each outline provides an inner outline which cooperates with one of the outlines positioned outside the each outline, to specify the objective area.

According to another feature of the third aspect of the invention, the processing system further comprises an objective-area specifying process for specifying, as the objective area bounded by the each outline, an area which is bounded by the each outline connected with the outer-outline data indicating that the each outline provides the outer outline and which is bounded by one of the outlines positioned inside the each outline and connected the inner-outline data indicating that the each outline provides the inner outline, in an order starting from an outermost one of the outlines toward an innermost one of the outlines.

According to another feature of the third aspect of the invention, the processing system further comprises an objective-area specifying process for specifying, as the objective area bounded by the each outline, an area which is bounded by the each outline connected with the inner-outline data indicating that the each outline provides the inner outline and which is bounded by one of the outlines positioned outside the each outline and connected the outer-outline data indicating that the each outline provides the outer outline, in an order starting from an innermost one of the outlines toward an outermost one of the outlines.

According to another feature of the third aspect of the invention, the attribute-data obtaining device obtains, in connection with the each outline, the set of attribute data comprising embroidery-related data which selectively include one of embroidery-need data indicating that the objective area bounded by the each outline is specified as the embroidery area by the embroidery-area specifying process, and no-embroidery data indicating that the objective area is not specified as the embroidery area.

According to another feature of the third aspect of the invention, the attribute-data obtaining device obtains, in connection with the each outline, the set of attribute data comprising embroidery-area specifying data as the objective-area specifying data which selectively include one of at least two sorts of data selected from the group consisting of entire-inside-area specifying data indicating that an entire inside area bounded by the each outline is specified as the embroidery area, part-inside-area specifying data indicating that a part of the inside area of the each outline is specified as the embroidery area, and no-area specifying data indicating that the inside area of the each outline is not specified as the embroidery area.

According to another feature of the third aspect of the invention, the embroidery-area specifying process process specifies, as the embroidery area, the part of the inside area of the each outline which is bounded by the each outline connected with the part-inside-area specifying data and is bounded by an outermost one of all inside outlines positioned inside the each outline.

According to a fourth aspect of the present invention, there is provided a medium including a memory for storing a control program which is used to control a computer, the memory being accessible by the computer to process, according to the control program stored in the memory, embroidery data which are used to control a sewing machine to form stitches filling an embroidery area and thereby produce an embroidery on at least one work sheet, the control program comprising the steps of obtaining a plurality of sets of outline data each set of which defines a corresponding one of a plurality of outlines comprising a first outline and at least one second outline positioned inside the first outline, obtaining, in connection with each of the outlines, a set of attribute data comprising objective-area specifying data specifying an objective area bounded by the each outline, and specifying, as the embroidery area, an objective area bounded by at least one of the outlines.

The medium in accordance with the fourth aspect of the invention may be a read only memory (ROM) card which is accessible or readable by the computer, such as a personal computer. Thus, the personal computer may be operated according to the control program recorded in the memory of the medium, so as to obtain the sets of outline data and the sets of attribute data and specify one or more embroidery areas.

According to a preferred feature of the fourth aspect of the invention, the step of obtaining the set of attribute data comprises obtaining, in connection with the each outline, the set of attribute data comprising the objective-area specifying data including outer-outline data indicating whether the each outline provides an outer outline which cooperates with one of the outlines positioned inside the each outline, to specify the objective area bounded by the each outline, and inner-outline data indicating whether the each outline provides an inner outline which cooperates with one of the outlines positioned outside the each outline, to specify the objective area.

According to another feature of the fourth aspect of the invention, the control program further comprises a step of specifying, as the objective area bounded by the each outline, an area which is bounded by the each outline connected with the outer-outline data indicating that the each outline provides the outer outline and which is bounded by one of the outlines positioned inside the each outline and connected to the inner-outline data indicating that the each outline provides the inner outline, in an order starting from an outermost one of the outlines toward an innermost one of the outlines.

According to another feature of the fourth aspect of the invention, the control program further comprises a step of specifying, as the objective area bounded by the each outline, an area which is bounded by the each outline connected with the inner-outline data indicating that the each outline provides the inner outline and which is bounded by one of the outlines positioned outside the each outline and connected the outer-outline data indicating that the each outline provides the outer outline, in an order starting from an innermost one of the outlines toward an outermost one of the outlines.

According to another feature of the fourth aspect of the invention, the step of obtaining the set of attribute data comprises obtaining, in connection with the each outline, the set of attribute data comprising embroidery-related data which selectively include one of embroidery-need data indicating that the objective area bounded by the each outline is specified as the embroidery area by the embroidery-area specifying process, and no-embroidery data indicating that the objective area is not specified as the embroidery area.

According to another feature of the fourth aspect of the invention, the step of obtaining the set of attribute data comprises obtaining, in connection with the each outline, the set of attribute data comprising embroidery-area specifying data as the objective-area specifying data which selectively include one of at least two sorts of data selected from the group consisting of entire-inside-area specifying data indicating that an entire inside area bounded by the each outline is specified as the embroidery area, part-inside-area specifying data indicating that a part of the inside area of the each outline is specified as the embroidery area, and no-area specifying data indicating that the inside area of the each outline is not specified as the embroidery area.

According to another feature of the fourth aspect of the invention, the step of specifying the embroidery area comprises specifying, as the embroidery area, the part of the inside area of the each outline which is bounded by the each outline connected with the part-inside-area specifying data and is bounded by an outermost one of all inside outlines positioned inside the each outline.

BRIEF DESCRIPTION OF THE DRAWINGS

The above and optional objects, features, and advantages of the present invention will better be understood by reading the following detailed description of the preferred embodiments of the invention when considered in conjunction with the accompanying drawings, in which.

DETAILED DESCRIPTION OF THE PREFERRED EMBODIMENTS

There will be described an embroidery data processing apparatus 8 to which the present invention is applied, by reference to FIGS. 1 through 7. The present processing apparatus 8 processes embroidery data which are supplied to a sewing machine 25 via a communication line 20.

Figure 1:
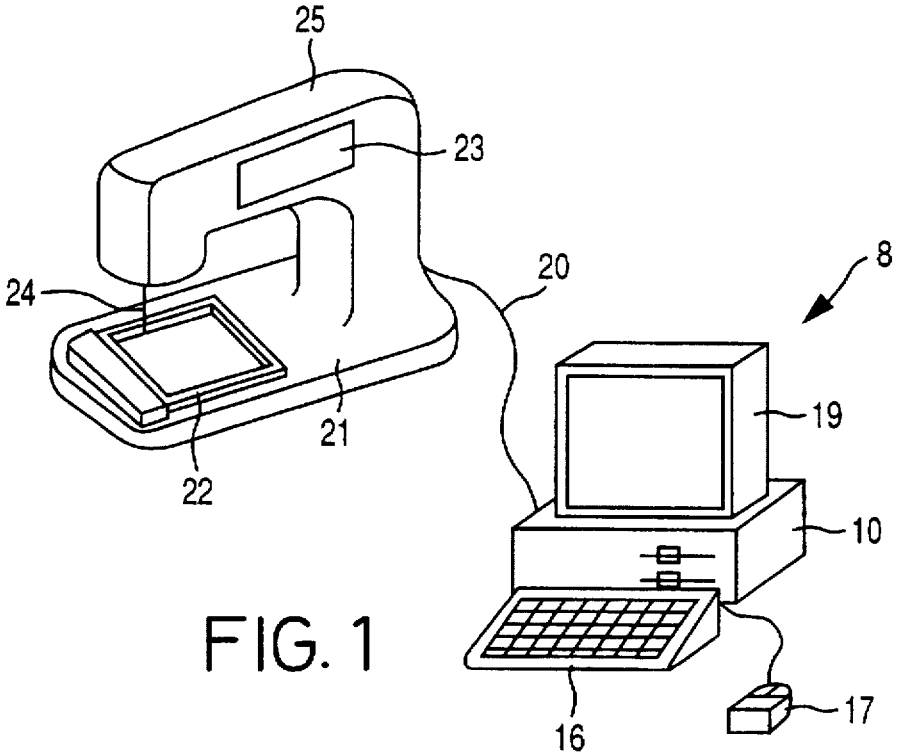
FIG. 1 is a perspective view of an embroidery data processing apparatus embodying the present invention, and a sewing machine which utilizes embroidery data processed by the processing apparatus.

First, the sewing machine 25 is described shortly by reference to FIG. 1. The sewing machine 25 includes a sewing bed 21; an embroidery frame 22 provided above the sewing bed 21, for holding one or more work sheets (not shown) such as fabric or leather; a moving device (not shown) for moving the embroidery frame 22, parallel to the sewing bed 21, to predetermined positions in an X-Y coordinate system prescribed for the sewing machine 25; and a sewing needle 24 and a shuttle device (not shown) which cooperate with each other to form embroidery stitches at the predetermined positions (i.e., stitch positions) on the work sheets while the embroidery frame 22 is moved by the moving device in the X-Y coordinate system.

The sewing machine 25 additionally includes a control device (not shown) which is essentially provided by a microcomputer which controls respective operations of the moving device, the sewing needle 24 (or needle bar to which the needle 24 is secured), and the shuttle device. According to embroidery data including sets of stitch-position data each set of which represents an X-direction and a Y-direction movement amount of the work sheets relative to the sewing needle 24, i.e., stitch position where the needle 24 penetrates the work sheets held by the embroidery frame 22 so as to form a corresponding one of the embroidery stitches.

The sewing machine 25 further includes a communication device (not shown) which communicates via the communication line 20 with an external device, e.g., embroidery data processing apparatus 8 so as to receive the embroidery data supplied from the processing apparatus 8.

In addition, the sewing machine 25 has a display device 23 which displays various messages, e.g., an instruction to a user to change a current embroidery thread having a certain color to another thread having a different color.

Figure 2:
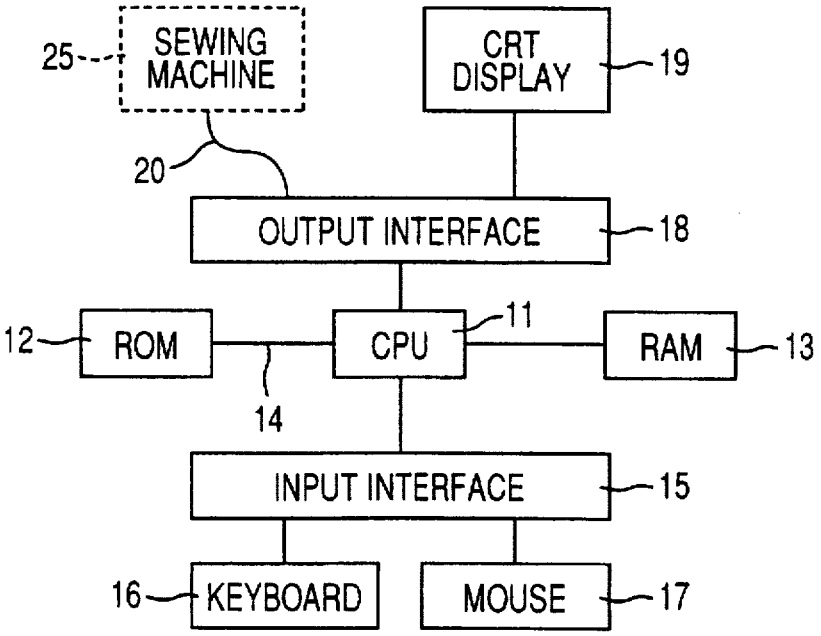
FIG. 2 is a block diagram of an electric arrangement of the processing apparatus of FIG. 1.

Next, the electric arrangement of the processing apparatus 8 is described by reference to FIG. 2. The processing apparatus is essentially provided by a personal computer 10 including a central processing unit (CPU) 11, a read only memory (ROM) 12, a random access memory (RAM) 13, an input interface 15, an output interface 18, and a bus 14.

The processing apparatus 8 additionally includes a cathode-ray-tube (CRT) display 19 which is connected to the computer 10 via the output interface 18. The CRT display 19 displays one or more outlines which defines or define one or more closed areas, and various messages to the user.

The processing apparatus 8 further includes a keyboard 16 and a mouse 17 each of which is connected to the computer 10 via the input interface 15. The keyboard 16 has various keys which are manually operable by the user for inputting, in the computer 10, attribute data (described later), and various commands, e.g., selection command and execution command. The mouse 17 functions as a pointing device which is manually operable by the user for inputting one or more sets of outline data representing one or more outlines defining one or more closed areas. The sets of outline data input by the user are stored in the RAM 13.

The personal computer 10 is connected to the sewing machine 25 via the output interface 18 and the communication line 20, so that the embroidery data processed by the processing apparatus 8 are sent to the sewing machine 25.

Hereinafter, there will be described the operation of the embroidery data processing apparatus 8 constructed as described above, by reference to the flow chart of FIG. 5 that represents a control program which is pre-stored in the ROM 12 and according to which the personal computer 10 or the CPU 11 processes embroidery data.

First, at Step S1, the CPU 11 controls the CRT display 19 to display a message which requests a user to input sets of outline data defining closed areas. A closed area means an inside area which is defined or bounded by one or more outlines. Regarding an example shown in FIG. 4, a doughnut-like closed area, A, is defined by two outlines, L1, L2; a doughnut-like closed area, B, is defined by two outlines, L2, L3; and an entire closed area, C, is defined by one outline L3. In addition, an entire closed area, A-B-C, consisting of the closed areas A, B, C is defined by one outline LI; an entire closed area, B-C, consisting of the closed areas B, C is defined by one outline L2; and a doughnut-like closed area, A-B, consisting of the closed areas A, B, is defined by two outlines L1, L3. The user inputs each of the circular outlines L1, L2, L3 by operating the mouse 17, while viewing respective images of the outlines L1, L2, L3 displayed on the CRT display 19. In the present embodiment, the user is instructed to input each of a plurality of outlines Ln in an order starting with an outermost outline and ending with an innermost outline. Regarding the example shown in FIG. 4, the user is required to input the three outlines L1, L2, L3 in the order of description. The CPU 11 produces, in the order of inputting of the outlines L1, L2, L3, three sets of outline data representing the input outlines LI, L2, L3, respectively, and stores, in the RAM 13, the produced sets of outline data in the same order.

Step S1 is followed by Step S2 to control the CRT display 19 to display a message which requests the user to input a set of attribute data in connection with each of the outlines Ln input and stored at Step S1. A set of attribute data input in connection with each outline Ln indicates whether each outline defines its entire inside area as an embroidery area, or whether each outline cooperates with an inside and/or an outside outline to define an inside and/or an outside doughnut-like embroidery area.

Figure 4:
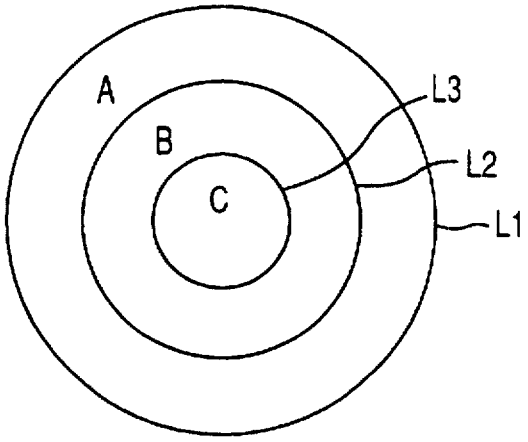
FIG. 4 is a view of an example of a plurality of outlines which define a plurality of closed inside areas selectively embroidering, respectively.

Here it is assumed that, regarding the example shown in FIG. 4, the user wishes to obtain a batch of embroidery data for forming stitches filling the doughnut-like closed area A defined by the outlines L1, L2, a batch of embroidery data for forming stitches filling the doughnut-like closed area B defined by the outlines L2, L3, and a batch of embroidery data for forming stitches filling the entire closed area C defined by the outline L3.

Figure 3:
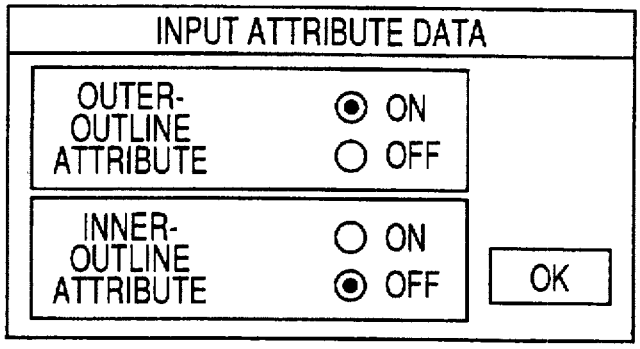
FIG. 3 is a view of a screen image which is displayed on a display device of the processing apparatus of FIG. 1 and which instructs a user to input attribute data in the processing apparatus.

At Step S2, the CRT display 19 additionally displays a screen image, as shown in FIG. 3, according to which the user inputs a set of attribute data for each of the outlines Ln in the same order as described above, while viewing the outlines Ln being displayed on the CRT display 19. Regarding the example shown in FIG. 4, first, the user inputs, for an outer-outline attribute of the first outline L1, "ON" data indicating that the first outline L1 provides an outer outline of a pair of inner and outer outlines defining a doughnut-like inside embroidery area (i.e., area A) and, for an inner-outline attribute of the first outline L1, "OFF" data indicating that the first outline L1 do not provide an inner outline of a pair of inner and outer outlines defining a doughnut-like outside embroidery area. Thus, the first outline L1 does not define any outside embroidery area.

Next, the user inputs a set of attribute data for the second outline L2. Since the second outline L2 provides an inner outline of a pair of inner and outer outlines defining a doughnut-like outside embroidery area (i.e., area A) and an outer outline of a pair of inner and outer outlines defining a doughnut-like inside embroidery area (i.e., area B), the user inputs, for the outer-outline attribute of the second outline L2, "ON" data indicating that the second outline L2 provides the outer outline of the pair of inner and outer outlines defining the doughnut-like inside embroidery area B and, for the inner-outline attribute of the second outline L2, "ON" data indicating that the second outline L2 provides the inner outline of the pair of inner and outer outlines defining the doughnut-like outside embroidery area A.

Subsequently, the user inputs a set of attribute data for the third outline L3. Since the third outline L3 provides an inner outline of a pair of inner and outer outlines defining a doughnut-like outside embroidery area (area B) and a single outline defining an entire inside embroidery area (area C), the user inputs, for the outer-outline attribute of the third outline L3, "OFF" data indicating that the third outline L3 defines the entire inside embroidery area and, for the inner-outline attribute of the third outline L3, "ON" data indicating that the third outline L3 provides the inner outline of the pair of inner and outer outlines defining the doughnut-like outside embroidery area. Thus, the "OFF" data input as the outer-outline attribute of each outline Ln indicates that that outline defines its entire inside area as an embroidery area.

Step S2 is followed by Step S3 to judge whether "ON" data have been input as the outer-outline attribute of the first one of the outlines Ln in the same order as described above. Regarding the example shown in FIG. 4, since "ON" data have been input as the outer-outline attribute of the first outline L1 and accordingly a positive judgment is made at Step S3, the control of the CPU 11 goes to Step S4.

At Step S4, the CPU 11 automatically searches, as a pairing inner outline, an outermost one of the outlines each of which is positioned inside the outline L1 and is connected with "ON" data input as the inner-outline attribute at Step S2. The outermost outline is positioned outside each of the other outlines positioned inside the outline L1 and connected with the "ON" data. Since "ON" have been input as the inner-outline attribute of each of the two inside outlines L2, L3 and the outline L2 is positioned outside the outline L3, the outline L2 is specified as the pairing inner outline at Step S4. However, if "OFF" data have been input as the inner-outline attribute of the outline L2, the outline L3 is specified as the pairing inner outline at Step S4.

Step S4 is followed by Step S5 to judge whether a pairing inner outline has been specified at Step S4. If a positive judgment is made at Step S5, the control of the CPU 11 goes to Step S6. On the other hand, if a negative judgment is made at Step S5, the control goes to Step S7.

At Step S6, the CPU 11 automatically produces a batch of embroidery data including sets of stitch-position data for forming embroidery stitches filling the doughnut-like closed area A defined by the outline L1 for which "ON" data are input as the outer-outline attribute and the outline L2 for which "ON" data are input as the inner-outline attribute. The manner of production of embroidery data carried out at Step S6 (or Step S7) is known in the art and disclosed in, e.g., Japanese Patent Application laid open for inspection purposes under Publication No. 56(1981)-132988, filed by the Assignee of the present application. The batch of embroidery data thus produced are stored in the RAM 13.

Step S4 is followed by Step S8 to judge whether embroidery data have been produced in connection with all the outlines Ln. Since the second and third outlines L2, L3 remain, a negative judgment is made at Step S8 and the control of the CPU 11 goes back to Step S3 and the following steps, to produce embroidery data for the second outline L2.

Since "ON" data were input as the outer-outline attribute for the second outline L2, a positive judgment is made at Step S3 and the control of the CPU 11 goes to Step S4 where the CPU 11 specifies the outline L3 as the pairing inner outline.

Step S4 is followed by Step S5 where a positive judgment is made because the outline L3 has been specified as the pairing inner outline at Step S4. Thus, the control of the CPU 11 proceeds with Step S6.

At Step S6, the CPU 11 automatically produces a batch of embroidery data for forming embroidery stitches filling the doughnut-like closed area B defined by the outline L2 for which "ON" data are input as the outer-outline attribute and the outline L3 for which "ON" data are input as the inner-outline attribute. The batch of embroidery data thus produced are stored in the RAM 13.

Step S6 is followed by Step S8 where a negative judgment is made because there remains the third outline L3. Thus, the control of the CPU 11 goes back to Step S3 and the following steps.

Since "OFF" data has been input as the outer-outline attribute for the third outline L3, a negative judgment is made at Step S3 and the control of the CPU 11 goes to Step S7.

At Step S7, the CPU 11 automatically produces a batch of embroidery data for forming embroidery stitches filling the entire inner area C defined by the outline L3 for which "OFF" data are input as the outer-outline attribute. The manner of production of embroidery data carried out at Step S7 is the same as carried out at Step S6. The batch of embroidery data thus produced are stored in the RAM 13.

Step S7 is followed by Step S8 where a positive judgment is made in the current cycle. Thus, the control of the CPU 11 goes to Step S9.

Figure 6:
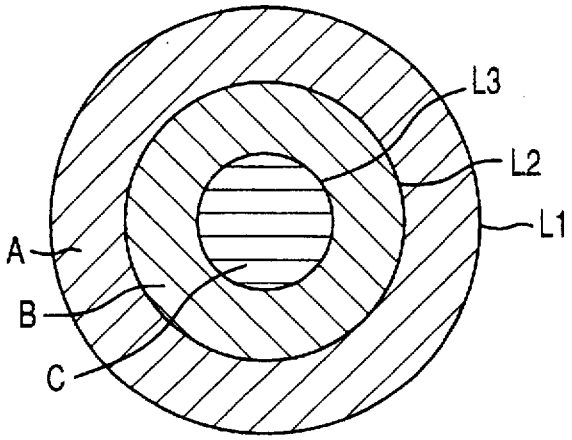
FIG. 6 is a view of an example of a plurality of embroideries which are formed by the sewing machine of FIG. 1 corresponding to the outlines of FIG. 4, according to a plurality of batches of embroidery data processed by the processing apparatus of FIG. 1, respectively.

At Step S9, the three batches of embroidery data stored in the RAM 13 are sent in the same order as the order of production thereof to the sewing machine 25 via the communication line 20. The sewing machine 25 forms embroidery stitches according the batches of embroidery data supplied from the processing apparatus 8 and provides three embroideries as shown in FIG. 6. The three embroideries may be formed with three color-different embroidery threads, respectively. In the latter case, the user changes the threads with one other in response to messages displayed on the display 23 of the sewing machine 25. The control device of the sewing machine 25 controls the display 23 to display a message which instructs the user to change the threads after an embroidery is formed according to a batch of embroidery data and before the following embroidery is formed according to the corresponding batch of embroidery data.

As is apparent from the foregoing description, the processing apparatus 8 is operable for inputting a set of attribute data in connection with each of outlines Ln. Each set of attribute data includes "ON" or "OFF" data as the outer-outline attribute of a corresponding outline, and "ON" or "OFF" data as the inner-outline attribute of the same outline. "OFF" data input as the outer-outline attribute in connection with each outline Ln indicates or requires that a batch of embroidery data be produced for forming stitches filling the entire inside area defined by that outline Ln. Regarding the example shown in FIG. 4, the processing apparatus 8 can automatically produce, in a short time, three batches of embroidery data for three embroidery areas A, B, C, in response to a single outline-data inputting sequence at Step Si and a single attribute-data inputting sequence at Step S2.

Next, there will be described another case where a user wishes to form two or more embroideries such that the embroideries are superposed on each other. Here it is assumed that the user wishes to first form embroidery stitches filling the entire inside area A-B-C which consists of the closed areas A, B, C and which is defined by the outline L1, subsequently form stitches filling the entire inside area B-C which consists of the closed areas B, C and which is defined by the outline L2, and then form stitches filling the entire inside area C which is defined by the outline L3. That is, the second embroidery for the area B-C is superposed on the first embroidery for the area A-B-C, and the third embroidery for the area C is superposed on the second embroidery for the area B-C. Three batches of embroidery data needed for embroidering the first to third embroideries are produced by the processing apparatus 8 according to the same control program represented by the flow chart of FIG. 5.

At Step S1, the user inputs sets of outline data representing the outlines L1 to L3 shown in FIG. 4, in the same manner as described previously.

At Step S2, the user inputs "OFF" data as each of the outer-outline and inner-outline attributes of each of the three outlines L1 to L3. To this end, the user has only to click, for each of the outlines L1 to L3, the mouse 17 with a cursor pointing an "OK" pad on the image screen of the CRT display 19 shown in FIG. 3, when both attributes show "OFF".

Step S2 is followed by Step S3 where the CPU 11 judges whether "ON" data have been input as the outer-outline attribute of the first outline L1. Since a negative judgment is made at Step S3, the control of the CPU 11 goes to Step S7.

At Step S7, the CPU 11 automatically produces embroidery data for forming embroidery stitches filling the entire inside area A-B-C defined by the outline L1 for which "OFF" data have been input as the outer-outline attribute. The batch of embroidery data produced are stored in the RAM 13.

Step S7 is followed by Step S8 where a negative judgment is made because there remain the second and third outlines L2, L3. Thus, the control of the CPU 11 goes back to Step S3.

At Step S3, a negative judgment is made because "OFF" data have been input as the outer-outline attribute of the second outline L2. Thus, the control of the CPU 11 goes to Step S7.

At Step S7, the CPU 11 automatically produces embroidery data for forming embroidery stitches filling the entire inside area B-C defined by the outline L2 for which "OFF" data have been input as the outer-outline attribute. The batch of embroidery data produced are stored in the RAM 13.

Step S7 is followed by Step S8 where a negative judgment is made because there remains the third outline L3. Thus, the control of the CPU 11 goes back to Step S3.

At Step S3, a negative judgment is made because "OFF" data have been input as the outer-outline attribute of the third outline L3. Thus, the control of the CPU 11 goes to Step S7.

At Step S7, the CPU 11 automatically produces embroidery data for forming embroidery stitches filling the entire inside area C defined by the outline L3 for which "OFF" data have been input as the outer-outline attribute. The batch of embroidery data produced are stored in the RAM 13.

Step S7 is followed by Step S8 where a positive judgment is made because there remains no outline Ln. Thus, the control of the CPU 11 goes to Step S9.

Figure 7:
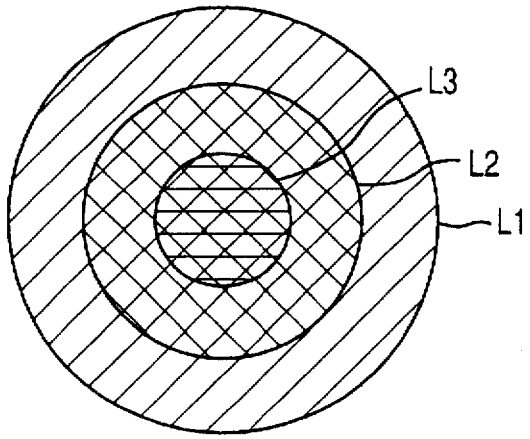
FIG. 7 is a view of another example of a plurality of embroideries which are formed by the sewing machine of FIG. 1 corresponding to the outlines of FIG. 4, according to a plurality of batches of embroidery data processed by the processing apparatus of FIG. 1, respectively.

At Step S9, the three batches of embroidery data stored in the RAM 13 are sent in the same order as the order of production thereof to the sewing machine 25 via the communication line 20. The sewing machine 25 forms embroidery stitches according to the batches of embroidery data supplied from the processing apparatus 8 and provides, as shown in FIG. 7, three embroideries which are superposed on one another.

As is apparent from the foregoing description, the processing apparatus 8 is operable for inputting "OFF" data as the outer-outline attribute of each of outlines Ln. "OFF" data input as the outer-outline attribute in connection with each outline Ln indicates or requires that a batch of embroidery data be produced for forming embroidery stitches filling the entire inside area defined by that outline Ln. Regarding the example shown in FIG. 4, the processing apparatus 8 can automatically produce, in a short time, three batches of embroidery data for three embroidery areas A-B-C, B-C, C, in response to a single outline-data inputting sequence at Step S1 and a single attribute-data inputting sequence at Step S2.

Figure 5:
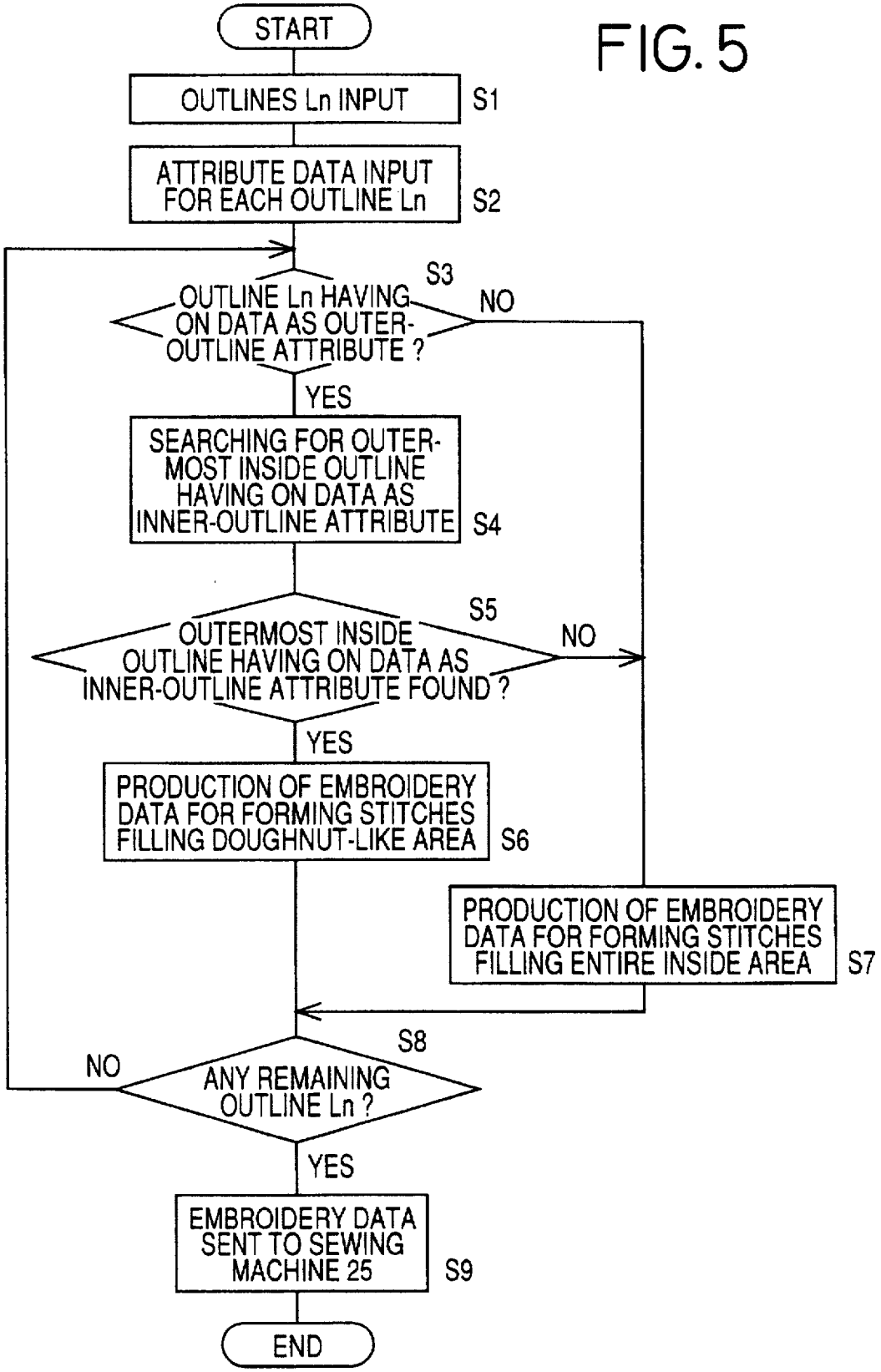
FIG. 5 is a flow chart according to which the processing apparatus of FIG. 1 processes embroidery data.

In the present embodiment, Step SI of FIG. 5 and a portion of the computer 10 for carrying out the step provides an outline-data obtaining device; Step S2 and a portion of the computer 10 for carrying out the step provides an attribute-data obtaining device; Steps S3-S5 and a portion of the computer 10 for carrying out those steps provides embroidery-area specifying process; and Steps S6 and 7 and a portion of the computer 10 for carrying out those steps provides embroidery-data producing process.

Next, referring to FIGS. 8 and 9, there will be described the second embodiment of the present invention. The second embodiment also relates to an embroidery-data processing apparatus which has the same hardware construction as that of the first embroidery-data processing apparatus 8 shown in FIG. 1 and which is connected to a sewing machine 25 via a communication line 20 as shown in FIG. 1.

Figure 9:
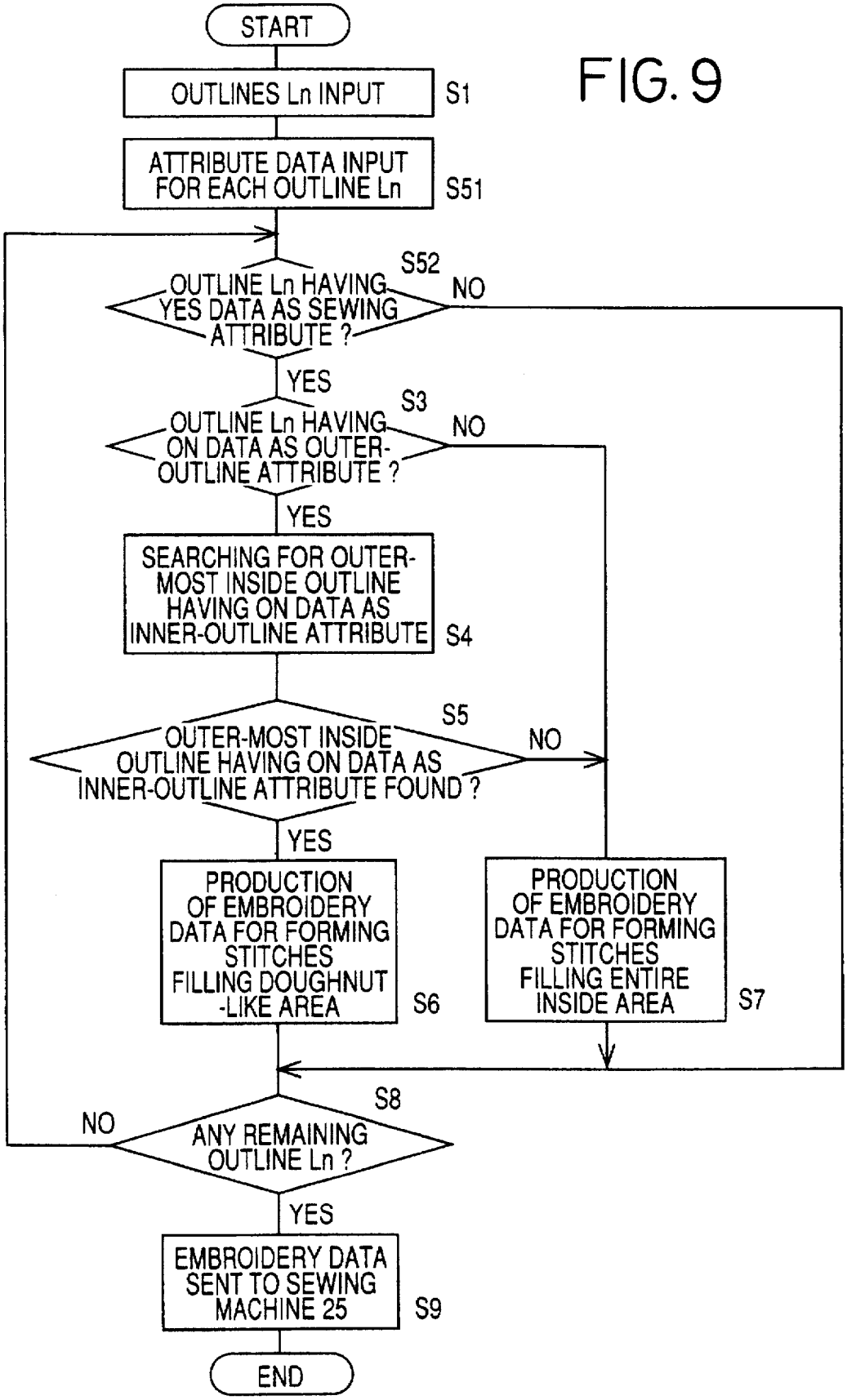
FIG. 9 is a flow chart according to which the second processing apparatus processes embroidery data.
Figure 8:
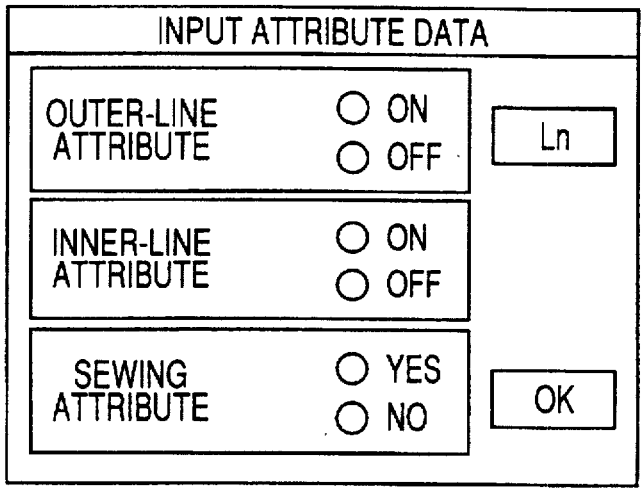
FIG. 8 is a view of another screen image which is displayed on a display device of another processing apparatus as a second embodiment of the invention and which instructs a user to input attribute data in the second processing apparatus.

However, in the second embodiment, not the attribute-data-input assisting image shown in FIG. 3 but a different one shown in FIG. 8 is displayed on a CRT display 19, and the second processing apparatus is operated according to not the control program represented by the flow chart of FIG. 5 but a different one represented by the flow chart of FIG. 9.

The attribute-data-input assisting image shown in FIG. 8 is different from that shown in FIG. 3 in that the former additionally includes the item of "SEWING ATTRIBUTE". In the first embodiment shown in FIGS. 3 and 5, a user cannot select not to sew any part of an inside area defined by each outline Ln, that is, he or she should select sewing of a part or an entirety of an inside area defined by each outline. However, in the second embodiment, the user can select, in connection with each outline Ln, not to sew any part of an inside area of each outline Ln, by inputting, at Step S51 of FIG. 9, "NO" data as the sewing attribute. An "Ln" pad provided in the image indicates a current outline Ln, for example, "L1" , "L2" , and so on.

Figure 10:
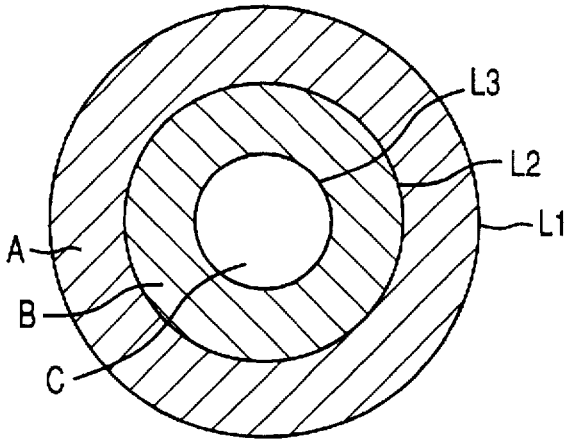
FIG. 10 is a view of an example of a plurality of embroideries, corresponding to the outlines of FIG. 4, which are formed by the sewing machine of FIG. 1 according to a plurality of batches of embroidery data processed by the second processing apparatus, respectively.

For example, if "NO" data are input, at Step S51, as the sewing attribute of the third outline L3 of the example shown in FIG. 4, a negative judgment is made at Step 52 where a CPU 11 judges whether the current outline Ln has "YES" data as the sewing attribute, and the control of the CPU 11 directly goes to Step S8. That is, no embroidery area is specified for the third outline L3, and no embroidery is formed in the area C as shown in FIG. 10. Steps S1 and S3-S9 of FIG. 9 are the same as the corresponding steps of FIG. 5, and the description of those steps is omitted.

In addition, if "NO" data are input, at Step S51, as the sewing attribute of the second outline L2 of the example shown in FIG. 4, a negative judgment is made at Step 52, and the control of the CPU 11 directly goes to Step S8. Thus, no embroidery area is specified for the second outline L2, and no embroidery is formed in an inside area as defined by the second outline L2. In the example shown in FIG. 11, however, "YES" data are input as the sewing attribute of the third outline L3, and an embroidery is formed in the area C as defined by the outline L3. If "NO" data are input as the sewing attribute of the third outline L3, no embroidery is formed in the area C, either.

Next, referring to FIGS. 12 and 13, there will be described the third embodiment of the present invention. The third embodiment also relates to an embroidery-data processing apparatus which has the same hardware construction as that of the first processing apparatus 8 shown in FIG. 1 and which is connected to a sewing machine 25 via a communication line 20 as shown in FIG. 1.

Figure 12:
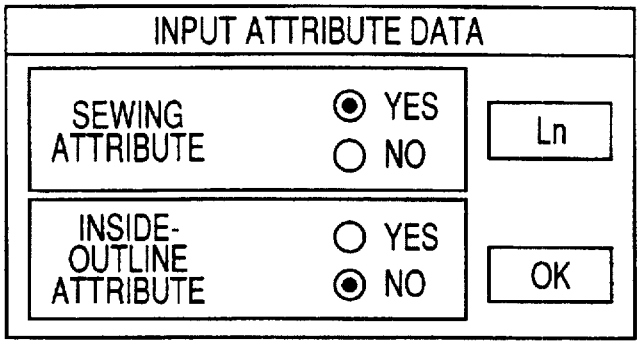
FIG. 12 is a view of another screen image which is displayed on a display device of another processing apparatus as a third embodiment of the invention and which instructs a user to input attribute data in the third processing apparatus.
Figure 13:
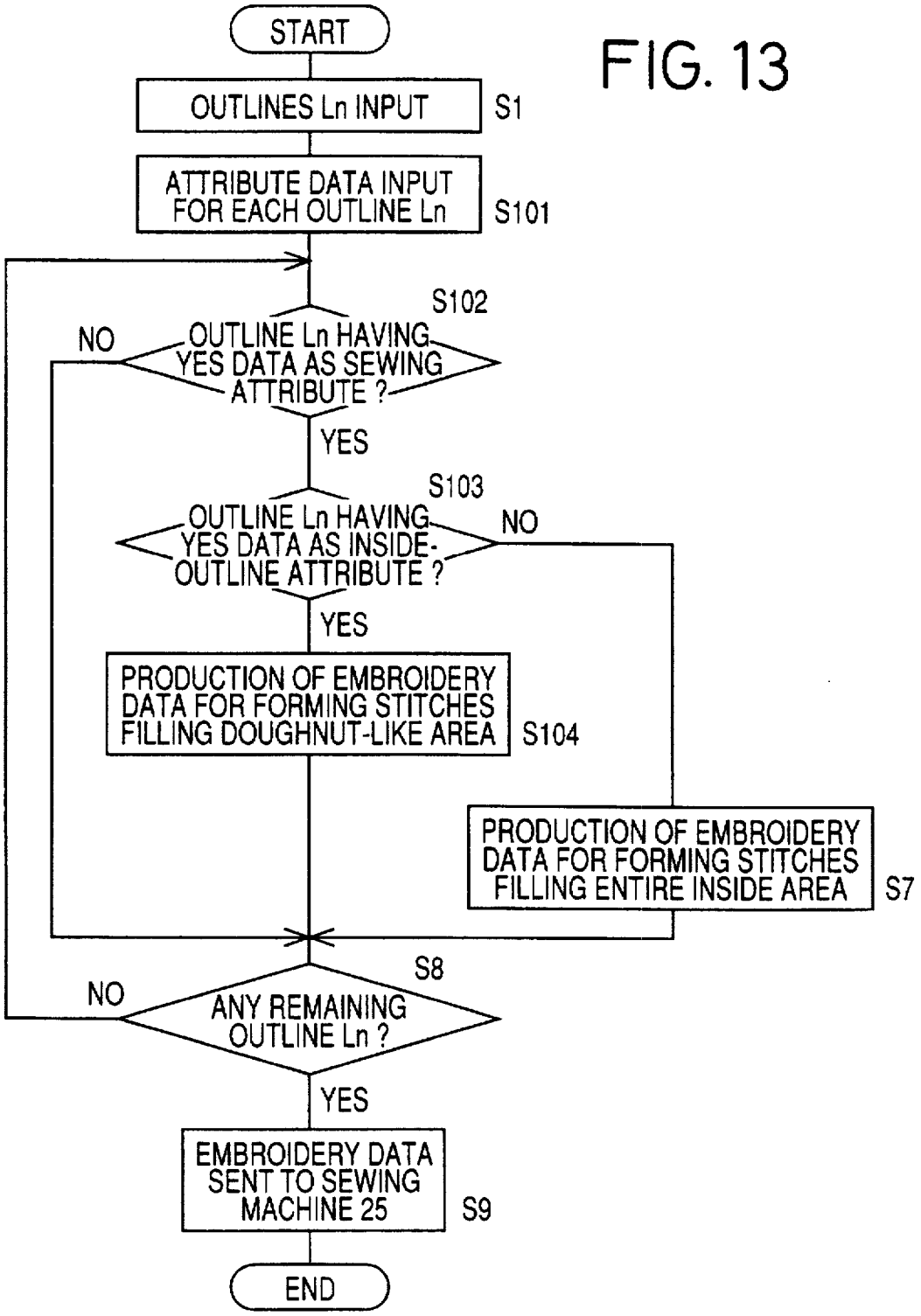
FIG. 13 is a flow chart according to which the third processing apparatus processes embroidery data.

However, in the third embodiment, not the attribute-data-input assisting image shown in FIG. 3 but a different one shown in FIG. 12 is displayed on a CRT display 19, and the third processing apparatus is operated according to not the control program represented by the flow chart of FIG. 5 but a different one represented by the flow chart of FIG. 13.

The attribute-data-input assisting image shown in FIG. 12 is different from that shown in FIG. 3 in that the former includes the same item "SEWING ATTRIBUTE" as that shown in FIG. 8, and an item "INSIDE-OUTLINE ATTRIBUTE" indicating whether the current outline Ln cooperates with an outermost one of the outlines positioned inside the current outline, to define a doughnut-like inside embroidery area. If "YES" data are input as the inside-outline attribute of each outline Ln, that outline cooperates with an outermost inside outline to define a doughnut-like inside embroidery area. On the other hand, if "NO" data are input as the inside-outline attribute of each outline Ln, that outline defines its entire inside area as an embroidery area.

Regarding the example shown in FIG. 4, if a user inputs, at Step S101 of FIG. 13, a set of attribute data including "YES" data as the sewing attribute and "YES" data as the inside-outline attribute, in connection with each of the first and second outlines L1, L2, and inputs a set of attribute data including "YES" data as the sewing attribute and "NO" data as the inside-outline attribute, in connection with the third outline L3, three embroideries are formed as shown in FIG. 6; and, if the user inputs a set of attribute data including "YES" data as the sewing attribute and "NO" data as the inside-outline attribute, in connection with each of the first to third outlines L1 to L3, three embroideries are formed as shown in FIG. 7. At Step S102, a CPU 11 judges whether the current outline Ln has "YES" data as the sewing attribute and, at Step S103, the CPU 11 judges whether the current outline Ln has "YES" data as the inside-outline attribute. At Step S104, the CPU 11 specifies, as an embroidery area, a doughnut-like area defined by the current outline Ln and an outermost one of the outlines positioned inside the current outline.

Figure 11:
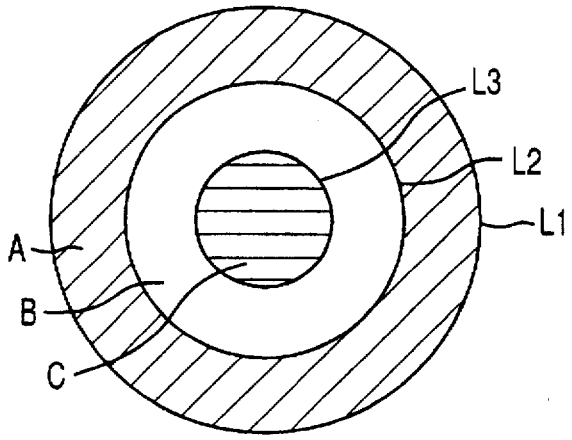
FIG. 11 is a view of another example of a plurality of embroideries, corresponding to the outlines of FIG. 4, which are formed by the sewing machine of FIG. 1 according to a plurality of batches of embroidery data processed by the second processing apparatus, respectively.

If the user inputs a set of attribute data including "NO" data as the sewing attribute, in connection with the third outline L3, two embroideries may be formed as shown in FIG. 10; and if the user inputs a set of attribute data including "NO" data as the sewing attribute, in connection with the second outline L2, two embroideries may be formed as shown in FIG. 11.

Next, referring to FIGS. 14 and 15, there will be described the fourth embodiment of the present invention. The fourth embodiment also relates to an embroidery-data processing apparatus which has the same hardware construction as that of the first processing apparatus 8 shown in FIG. 1 and which is connected to a sewing machine 25 via a communication line 20 as shown in FIG. 1.

Figure 14:
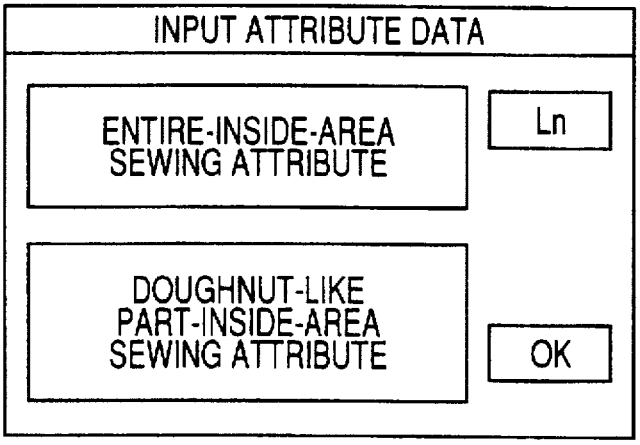
FIG. 14 is a view of another screen image which is displayed on a display device of another processing apparatus as a fourth embodiment of the invention and which instructs a user to input attribute data in the fourth processing apparatus.
Figure 15:
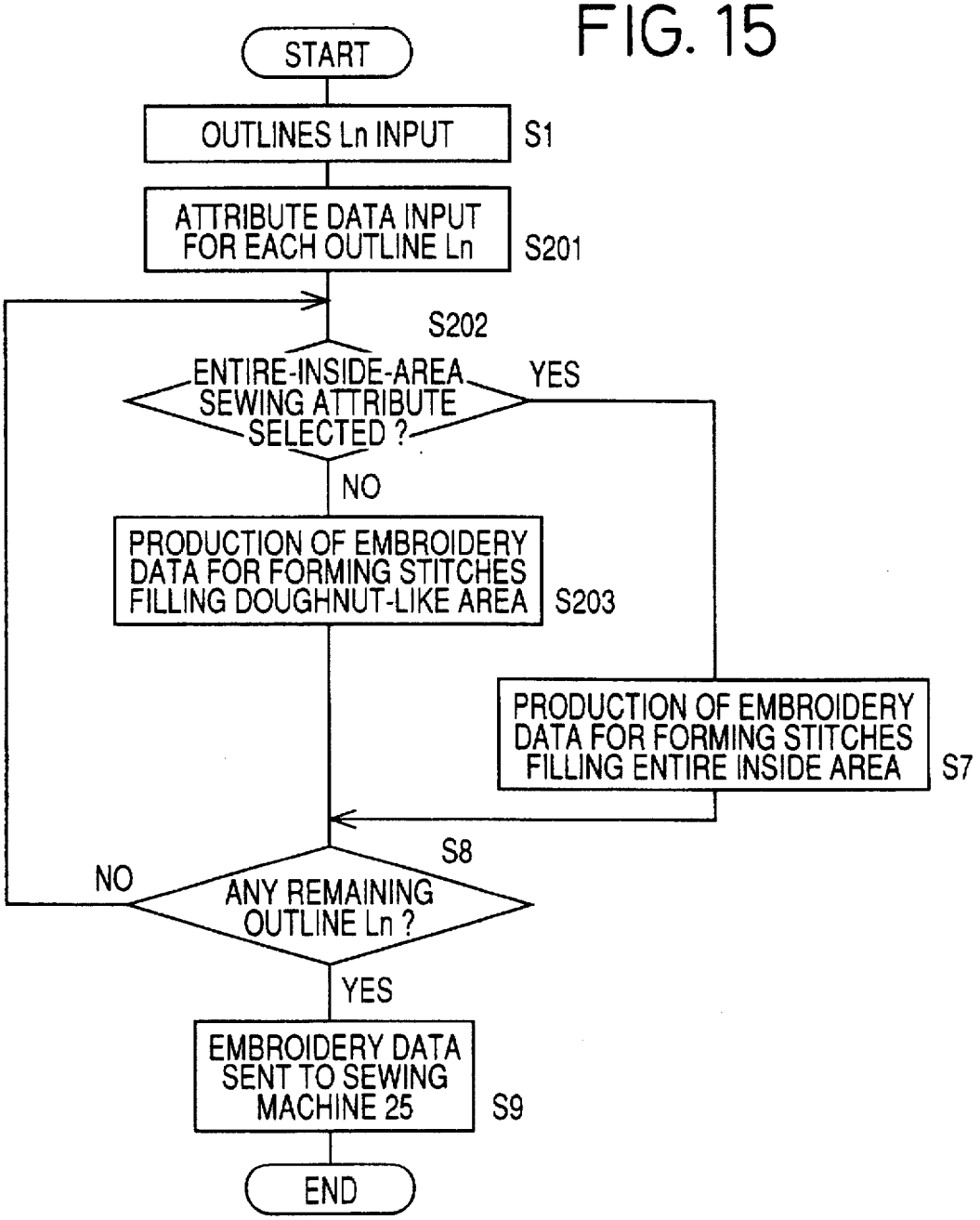
FIG. 15 is a flow chart according to which the fourth processing apparatus processes embroidery data.

However, in the fourth embodiment, not the attribute-data-input assisting image shown in FIG. 3 but a different one shown in FIG. 14 is displayed on a CRT display 19, and the fourth processing apparatus is operated according to not the control program represented by the flow chart of FIG. 5 but a different one represented by the flow chart of FIG. 15.

The attribute-data-input assisting image shown in FIG. 14 is different from that shown in FIG. 3 in that a user selects one of two pads "ENTIRE-INSIDE-AREA SEWING ATTRIBUTE" and "DOUGHNUT-LIKE PART-INSIDE-AREA SEWING ATTRIBUTE", in connection with each outline Ln. If the latter or second data are input in connection with each outline Ln, that outline cooperates with an outermost one of outlines positioned inside that outline, to define a doughnut-like inside embroidery area. On the other hand, if the former or first data are input for each outline Ln, a CPU 11 specifies, as an embroidery area, an entire inside area defined by that outline.

Regarding the example shown in FIG. 4, if a user inputs, at Step S201 of FIG. 15, the entire-inside-area sewing attribute in connection with each of the first to third outlines LI to L3, three embroideries are formed as shown in FIG. 7; and, if the user inputs the doughnut-like part-inside-area sewing attribute in connection with each of the first and second outlines L1 and L2 and the entire-inside-area sewing attribute in connection with the third outline L3, three embroideries are formed as shown in FIG. 6. At Step S202, the CPU 11 judges whether the current outline Ln has the entire-inside-area sewing attribute. At Step S203, the CPU 11 specifies, as an embroidery area, a doughnut-like area defined by the current outline Ln and an outermost one of the outlines positioned inside the current outline.

If the user inputs a set of attribute data including "NO" data as the sewing attribute, in connection with the third outline L3, two embroideries may be formed as shown in FIG. 10; and if the user inputs a set of attribute data including "NO" data as the sewing attribute, in connection with the second outline L2, two embroideries may be formed as shown in FIG. 11.

Next, referring to FIGS. 16 and 17, there will be described the fifth embodiment of the present invention. The fifth embodiment also relates to an embroidery-data processing apparatus which has the same hardware construction as that of the first processing apparatus 8 shown in FIG. 1 and which is connected to a sewing machine 25 via a communication line 20 as shown in FIG. 1.

Figure 16:
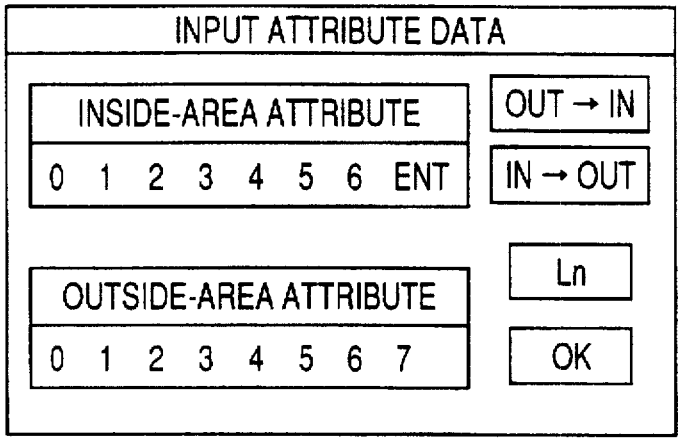
FIG. 16 is a view of another screen image which is displayed on a display device of another processing apparatus as a fifth embodiment of the invention and which instructs a user to input attribute data in the fifth processing apparatus.
Figure 17:
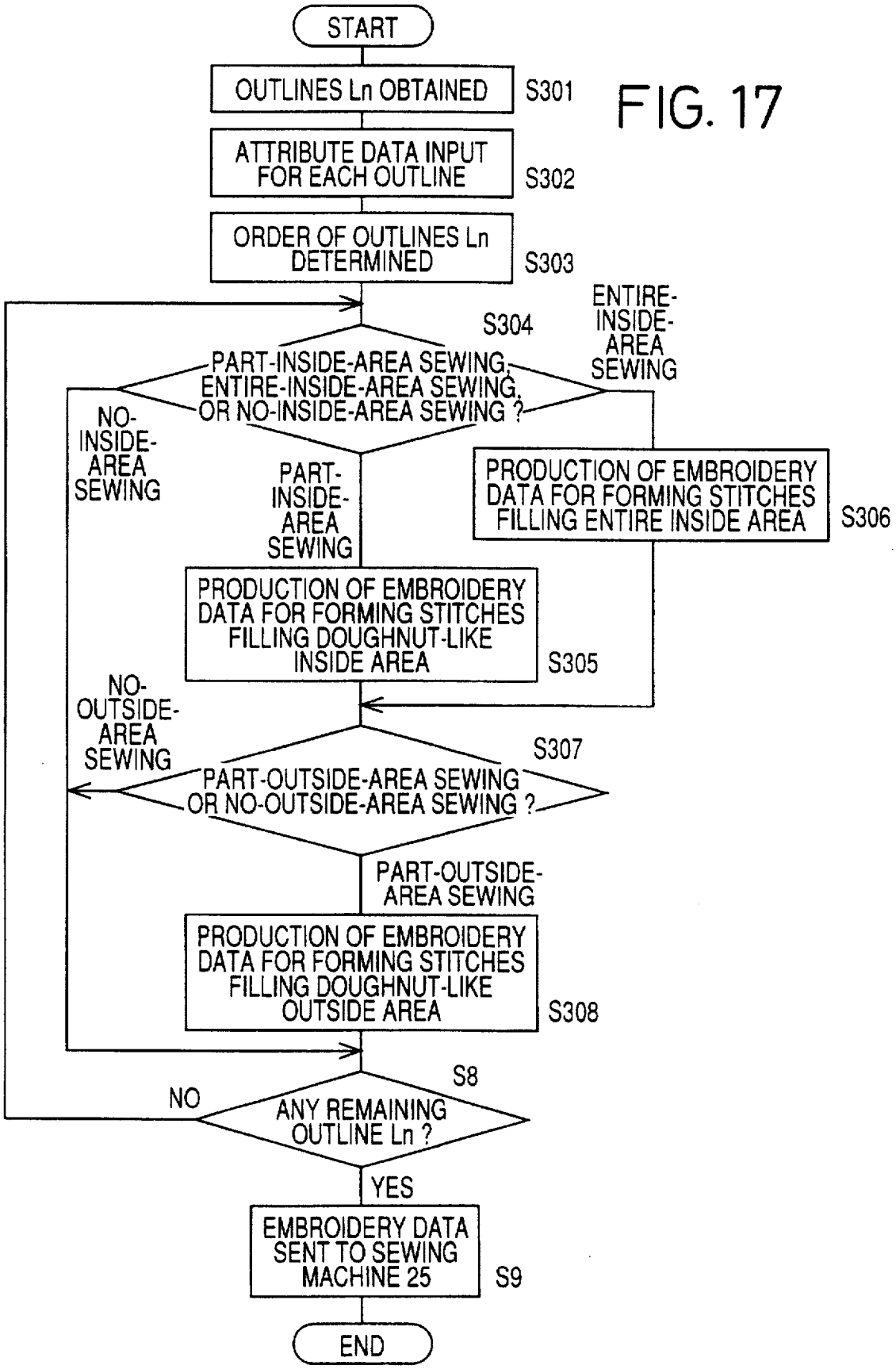
FIG. 17 is a flow chart according to which the fifth processing apparatus processes embroidery data.

However, in the fifth embodiment, not the attribute-data-input assisting image shown in FIG. 3 but a different one shown in FIG. 16 is displayed on a CRT display 19, and the fifth processing apparatus is operated according to not the control program represented by the flow chart of FIG. 5 but a different one represented by the flow chart of FIG. 17.

The attribute-data-input assisting image shown in FIG. 16 is different from that shown in FIG. 3 in that a user selects one of two processing directions, first direction from "OUT" to "IN" and second direction from "IN" to "OUT". In the above-described first to fourth embodiments, the CPU 11 processes embroidery data starting with the outermost outline and ending with the innermost outline. However, in the present embodiment, the user selects, at Step S302 of FIG. 17, one of the two directions, first direction from the outermost one to the innermost one, and second direction from the innermost one to the outermost one. At Step S303, a CPU 11 determines the order of processing of outlines Ln based on the first or second direction selected at Step S302. Step S301 corresponds to Step S1 of FIG. 5. At Step S301, the CPU 11 may read one or more sets of outline data from an external memory, such as a floppy disk, which is inserted in a reading device of a personal computer 10. Otherwise, an image reader (not shown) of, e.g., a facsimile machine may be used to read one or more outlines, produce one or more sets of outline data defining the outlines, and transfer the outline data to the personal computer 10 to which the facsimile machine is connectable.

At Step S302, the user selects, as an inside-area attribute, one of "0", "1", . . . , "6", and "ENT" and selects, as an outside-area attribute, one of "0", "1", . . . , "6", and "7", on the attribute-data-input assisting image shown in FIG. 16, in connection with each of outlines Ln. The data "0" input as the inside-area attribute of each outline Ln indicates that no embroidery area is specified in an inside area defined by each outline Ln; one of the six sorts of data from "1" to "6" input as the inside-area attribute of each outline Ln indicates that a doughnut-like inside area defined by each outline Ln and the "1st" to "6th" one of the outlines positioned inside that outline as counted inward from that outline, is specified as an embroidery area; and the data "ENT" input as the inside-area attribute of each outline Ln indicates that an entire inside area defined by each outline Ln is specified as an embroidery area. Similarly, the data "0" input as the outside-area attribute of each outline Ln indicates that no embroidery area is specified in an outside area defined by each outline Ln; and one of the seven sorts of data from "1" to "7" input as the outside-area attribute of each outline Ln indicates that a doughnut-like inside area defined by each outline Ln and the "1st" to "7th" one of the outlines positioned outside that outline as counted outward from that outline, is specified as an embroidery area. It is impossible to specify, as an embroidery area, an entire outside area defined by each outline Ln.

At Step S304, the CPU 11 judges whether the current outline Ln has the doughnut-like part-inside-area sewing attribute, the entire-inside-area sewing attribute, or the no-inside-area sewing attribute. In the first case, the control of the CPU 11 goes to Step S305; in the second case, the control goes to Step S306; and in the last case, the control directly goes to Step S8 that is the same as Step S8 of FIG. 3. At Step S305, the CPU 11 specifies an inside outline based on one of the six sorts of data from "1" to "6" input at Step S302 and specifies, as an embroidery area, a doughnut-like area defined by the current outline Ln and the specified inside outline. In addition, the CPU 11 produces sets of stitch-position data for forming stitches filling the doughnut-like embroidery area. At Step S306, the CPU 11 specifies, as an embroidery area, an entire inside area defined by the current outline Ln and produces sets of stitch-position data for forming stitches filling the entire inside embroidery area.

Similarly, at Step S307, the CPU 11 judges whether the current outline Ln has the doughnut-like part-outside-area sewing attribute or the no-outside-area sewing attribute. In the first case, the control of the CPU 11 goes to Step S308; and in the second case, the control directly goes to Step S8. At Step S308, the CPU 11 specifies an outside outline based on one of the seven sorts of data from "1" to "7" input at Step S302 and specifies, as an embroidery area, a doughnut-like area defined by the current outline Ln and the specified outside outline. In addition, the CPU 11 produces sets of stitch-position data for forming stitches filling the doughnut-like embroidery area.

Regarding the example shown in FIG. 4, if a user inputs, at Step S302 of FIG. 16, the data "1" as the inside-area attribute in connection with each of the first and second outlines L1, L2, and the data "ENT" as the inside-area attribute in connection with the third outline L3, three embroideries are formed as shown in FIG. 6; and, if the user inputs the data "ENT" as the inside-area attribute in connection with each of the first to third outlines L1 to L3, three embroideries are formed as shown in FIG. 7. If the user inputs the data "1" as the inside-area attribute in connection with each of the first and second outlines L1, L2 and the data "0" in connection with the third outline L3, two embroideries are formed as shown in FIG. 10; and if the user inputs the data "1" as the inside-area attribute in connection with the first outline L1, the data "0" in connection with the second outline L2, and the data "ENT" in connection with the third outline L3, two embroideries are formed as shown in FIG. 11.

The three embroideries shown in FIG. 6 may also be obtained by inputting the data "ENT" as the inside-area attribute in connection with the innermost outline L3, the data "1" as the outside-area attribute in connection with the innermost outline L3, and the data "1" as the outside-area attribute in connection with the middle outline L2, or by inputting the data "ENT" as the inside-area attribute in connection with the innermost outline L3, the data "1" as the inside-area attribute in connection with the middle outline L2, and the data "1" as the outside-area attribute in connection with the middle outline L2.

While the present invention has been described in its preferred embodiments, the present invention may otherwise be embodied.

For example, although in the illustrated embodiments the sets of outline data defining the outlines Ln are produced by the personal computer 10 in response to user's operation of the keyboard 16 and/or the mouse 17, it is possible that an image reader such as an image scanner be used to read, from an original, an original image including one or more outlines and produce one or more sets of outline data defining the outline or outlines according to a known image-data processing technique, e.g., outline extracting technique. Otherwise, various pointing devices other than the mouse 17 may be used to produce one or more sets of outline data. For example, a light-pen may be employed in addition to, or in place of, the mouse 17.

While in the illustrated embodiments a doughnut-like embroidery area (e.g., area A, B shown in FIG. 4) is defined by a single first outline and a single second outline positioned inside the first outline, the principle of the present invention may be applicable to producing a batch of embroidery data for forming stitches filling an embroidery area defined by a single first outline and two or more second outlines positioned inside the first outline. Respective inside areas defined by the second outlines may not overlap each other, i.e., may be completely apart from each other, inside the first outline. In the latter case, an identical set of attribute data may be input in connection with each of the second outlines.

Although in the illustrated embodiments the embroidery-data processing apparatus 8 produces batches of embroidery data and transfer the embroidery data to the sewing machine 25 via the communication line 20, it is possible that the processing apparatus 8 specify one or more embroidery areas based on sets of outline data and sets of attribute data and transfer one or more sets of embroidery-area data defining the embroidery area or areas to the sewing machine 25, or that the processing apparatus 8 obtain or gather sets of outline data and sets of attribute data and transfer those data to the sewing machine 25. In either case, the control device of the sewing machine 25 may produce embroidery data based on the embroidery-area data or based on the sets of outline data and the sets of attribute data.

It is to be understood that the present invention may be embodied with other changes, improvements, and modifications that may occur to those skilled in the art without departing from the scope and spirit of the invention defined in the appended claims.

What is claimed is:

1. (Amended) A system for processing embroidery data which are used to control a sewing machine to form stitches filling an embroidery area and thereby produce an embroidery on at least one work sheet, the system comprising:

an outline-data obtaining device which obtains a plurality of sets of outline data each set of which defines a corresponding one of a plurality of outlines comprising a first outline and at least one second outline positioned inside said first outline; and an attribute-data obtaining device which obtains, in connection with each of said outlines and independent of the other outlines, a set of attribute data which indicates at least one of an inside-area embroidery command to produce a batch of inside-area embroidery data to form said stitches filling, as said embroidery area, at least a part of an inside area of said each outline, and a part-outside-area embroidery command to produce a batch of part-outside-area embroidery data to form said stitches filling, as said embroidery area, a part of an outside area of said each outline.

2. A system according to claim 1, wherein said attribute-data obtaining device comprises first obtaining means for obtaining, in connection with said each outline, said set of attribute data which selectively indicates, as said inside-area embroidery command, one of an entire-inside-area embroidery command to produce, as said inside-area embroidery data, a batch of entire-inside-area embroidery data to form said stitches filling, as said embroidery area, an entirety of said inside area of said each outline, and a part-inside-area embroidery command to produce, as said inside-area embroidery data, a batch of part-inside-area embroidery data to form said stitches filling, as said embroidery area, said part of said inside area of said each outline.

3. A system according to claim 2, further comprising embroidery-area specifying means for specifying, as said embroidery area, said entirety of said inside area of said each outline, when said first obtaining means of said attribute-data obtaining device obtains, in connection with said each outline , said set of attribute data indicating said entire-inside-area embroidery command.

4. A system according to claim 2, wherein said attribute-data obtaining device further comprises second obtaining means for obtaining, in connection with at least one of said outlines, said set of attribute data indicating said part-outside-area embroidery command to produce said batch of part-outside-area embroidery data.

5. A system according to claim 4, further comprising embroidery-area specifying means for specifying, as said embroidery area, said part of said inside area of said each outline, when said first obtaining means obtains, in connection with said each outline, said set of attribute data indicating said part-inside-area embroidery command and said second obtaining means of said attribute-data obtaining device obtains said set of attribute data indicating said part-outside-area embroidery command, in connection with at least one of said outlines which is positioned inside said each outline.

6. A system according to claim 5, wherein said embroidery-area specifying means comprises means for specifying, as said embroidery area, said part of said inside area of said each outline which is defined by said each outline and an outermost one of all inside outlines each of which is positioned inside said each outline and is connected with said part-outside-area embroidery command obtained by said second obtaining means, said outermost inside outline being positioned outside of each of the other inside outlines.

7. A system according to claim 4, further comprising embroidery-area specifying means for specifying, as said embroidery area, said entirety of said inside area of said each outline, when said first obtaining means of said attribute-data obtaining device obtains, in connection with said each outline, said set of attribute data indicating said part-inside-area embroidery command and said second obtaining means of said attribute-data obtaining device does not obtain said set of attribute data indicating said part-outside-area embroidery command, in connection with any of said outlines which is positioned inside said each outline.

8. A s y stem according to claim 2, further comprising embroidery-area specifying means for specifying, as s aid embroidery area, said part of said inside area of said each outline which is defined by said each outline and one of all inside outlines positioned inside said each outline, said one inside outline being apart inward from said each outline with a predetermined number of the inside outlines being positioned between said each outline and said one inside outline.

9. A system according to claim 1, further comprising embroidery-data producing means for producing, as said embroidery data, a t least one of a set of embroidery-area data which defines, as said embroidery area, at least one of said at least part of said inside area of said each outline and said part of said outside area of said each outline, and a plurality of sets of stitch-position data each set of which defines a corresponding one of a plurality of stitch positions where a sewing needle of the sewing machine penetrates the work sheet to form a corresponding one of said stitches filling, as said embroidery area, at least one of said at least part of said inside area of said each outline and said part of said outside area of said each outline.

10. A system for processing embroidery data which are used to control a sewing machine to form stitches filling an embroidery area and thereby produce an embroidery on at least one work sheet, the system comprising:

an outline-data obtaining device which obtains a plurality of sets of outline data each set of which defines a corresponding one of a plurality of outlines comprising a first outline and at least one second outline positioned inside said first outline; and an attribute-data obtaining device which selectively obtains, in connection with each of said outlines and independent of the other outlines, one of a set of sewing attribute data which indicates at least one of an inside-area embroidery command to produce a batch of inside-area embroidery data to form said stitches filling, as said embroidery area, at least a part of an inside area defined by said each outline, and a part-outside-area embroidery command to produce a batch of part-outside-area embroidery data to form said stitches filling, as said embroidery area, a part of an outside area defined by said each outline, and a set of non-sewing attribute data which indicates a non-embroidery command not to produce any embroidery data to form any stitches filling any of said at least part of said inside area defined by said each outline and said part of said outside area defined by said each outline.

11. A system according to claim 10, wherein said attribute-data obtaining device comprises first obtaining means for obtaining, in connection with at least one of said outlines, said set of sewing attribute data which selectively indicates, as said inside-area embroidery command, one of an entire-inside-area embroidery command to produce, as said inside-area embroidery data, a batch of entire-inside-area embroidery data to form said stitches filling, as said embroidery area, an entirety of said inside area of said one outline, and a part-inside-area embroidery command to produce, as said inside-area embroidery data, a batch of part-inside-area embroidery data to form said stitches filling, as said embroidery area, said part of said inside area of said one outline.

12. A system according to claim 11, further comprising embroidery-area specifying means for specifying, as said embroidery area, said entirety of said inside area of said one outline, when said first obtaining means of said attribute-data obtaining device obtains, in connection with said one outline, said set of sewing attribute data indicating said entire-inside-area embroidery command.

13. A system according to claim 11, wherein said attribute-data obtaining device further comprises second obtaining means for obtaining, in connection with at least one of said outlines, said set of sewing attribute data indicating said part-outside-area embroidery command to produce said batch of part-outside-area embroidery data.

14. A system according to claim 13, further comprising embroidery-area specifying means for specifying, as said embroidery area, said part of said inside area of said one outline, when said first obtaining means of said attribute-data obtaining device obtains, in connection with said one outline, said set of sewing attribute data indicating said part-inside-area embroidery command and said second obtaining means of sa id attribute-data obtaining device obtains said set of attribute data indicating said part-outside-area embroidery command, in connection with at least one of said outlines which is positioned inside said one outline.

15. A system according to claim 14, wherein said embroidery -area specifying means comprises means for specifying, as said embroidery area, said part of said inside area of said one outline which is defined by said one outline and an outermost one of all inside outlines each of which is positioned inside said one outline and is connected with said part-outside-area embroidery command obtained by said second obtaining means, said outermost inside outline being positioned outside of each of the other inside outlines.

16. A system according to claim 13, further comprising said embroidery-area specifying means comprises means for specifying, as said embroidery area, said entirety of said inside area of said one outline, when said first obtaining means of said attribute-data obtaining device obtains, in connection with said one outline, said set of attribute data indicating said part-inside-area embroidery command and said second obtaining means of said attribute-data obtaining device does not obtain said set of attribute data indicating said part-outside-area embroidery command, in connection with any of said outlines which is positioned inside said one outline.

17. A system according to claim 11, further comprising embroidery-area specifying means for specifying, as said embroidery area, said part of said inside area of said one outline which is defined by said one outline and one of all inside outlines positioned inside said one outline, said one of said all inside outlines being apart inward from said one outline with a predetermined number of the inside outlines being positioned between said one outline and said one of said all inside outlines.

18. A system according to claim 10, further comprising embroidery-data producing means for producing, as said embroidery data, at least one of a set of embroidery-area data which defines, as said embroidery area, at least one of said at least part of said inside area of at least one of said outlines and said part of said outside area of said one outline, and a plurality of sets of stitch-position data each set of which define a corresponding one of a plurality of stitch positions where a sewing needle of the sewing machine penetrates the work sheet to form a corresponding one of said stitches filling, as said embroidery area, at least one of said at least part of said inside area of at least one of said outlines and said part of said outside area of said one outline.

19. A system according to claim 18, wherein said embroidery-data producing means comprises a computer.

20. A system according to claim 19, wherein said computer comprises a connector which is adapted to be connected to the sewing machine via a communication line.

21. A system according to claim 19, wherein said computer comprises a control device which is incorporated in the sewing machine to control a sewing operation of the sewing machine.

22. A system according to claim 10, wherein said outline-data obtaining device comprises a command input device which is operable by a user for inputting a outline-data producing command, an outline-data producing device which produces at least one of said sets of outline data based on said outline-data producing command input through said input device, and a memory which stores said one set of outline data produced by said outline-data producing device.

23. A system according to claim 22, wherein said command input device comprises a display and at least one of a keyboard and a pointing device such as a mouse, and wherein said outline-data producing device comprises a computer which is connected to said display and said one of said keyboard and said pointing device.

24. A system according to claim 10, wherein said outline-data obtaining device comprises a reading device which reads at least one of said sets of outline data from an external memory, such as a floppy disk, which is settable in, and removable from, said reading device and in which said one set of outline data is stored.

25. A system according to claim 10, wherein said attribute-data obtaining device comprises a data input device which is operable by a user for inputting said one of said set of sewing attribute data and said set of non-sewing attribute data, in connection with said each outline, and a memory which stores said one of said set of sewing attribute data and said set of non-sewing attribute data input through said data input device.

26. A system for processing embroidery data which are used to control a sewing machine to form stitches filling a n embroidery area and thereby produce an embroidery on at least one work sheet, the system comprising:

an outline-data obtaining device which obtains a plurality of sets of outline data each set of which defines a corresponding one of a plurality of outlines comprising a first outline and at least one second outline positioned inside said first outline;

an attribute-data obtaining device which obtains, in connection with each of said outlines, a set of attribute data comprising at least one set of objective-area specifying data specifying at least one of an inside objective area and an outside objective area which are bounded by said each outline, independent of the other outlines; and embroidery-area specifying means for specifying, as said embroidery data, at least one objective area bounded by at least one of said outlines.

27. A system according to claim 26, wherein said attribute-data obtaining device comprises means for obtaining, in connection with said each outline, said set of attribute data comprising said objective-area specifying data including outer-outline data indicating whether said each outline provides an outer outline which cooperates with one of said outlines positioned inside said each outline, to specify said objective area bounded by said each outline, and inner-outline data indicating whether said each outline provides an inner outline which cooperates with one of said outlines positioned outside said each outline, to specify said objective area.

28. A system according to claim 27, further comprising objective-area specifying means for specifying, as said objective area bounded by said each outline, an area which is bounded by said each outline connected with said outer-outline data indicating that said each outline provides said outer outline and which is bounded by one of said outlines positioned inside said each outline and connected said inner-outline data indicating that said each outline provides said inner outline, in an order starting from an outermost one of said outlines toward an innermost one of said outlines.

29. A system according to claim 27, further comprising objective-area specifying means for specifying, as said objective area bounded by said each outline, an area which is bounded by said each outline connected with said inner-outline data indicating that said each outline provides said inner outline and which is bounded by one of said outlines positioned outside said each outline and connected said outer-outline data indicating that said each outline provides said outer outline, in an order starting from an innermost one of said outlines toward an outermost one of said outlines.

30. A system according to claim 26, wherein said attribute-data obtaining device comprises means for obtaining, in connection with said each outline, said set of attribute data comprising embroidery-related data which selectively include one of embroidery-need data indicating that said objective are a bounded by said each outline is specified as said embroidery area by said embroider-area specifying means, and no-embroidery data indicating that said objective area is not specified as said embroidery area.

31. A system according to claim 26, wherein said attribute-data obtaining device comprises means for obtaining, in connection with said each outline, said set of attribute data comprising embroidery-area specifying data as said objective-area specifying data which selectively include one of at least two sorts of data selected from the group consisting of entire-inside-area specifying data indicating that an entire inside area bounded by said each outline is specified as said embroidery area, part-inside-area specifying data indicating that a part of said inside area of said each outline is specified as said embroidery area, and no-area specifying data indicating that said inside area of said each outline is not specified as said embroidery area.

32. A system according to claim 31, wherein said embroidery-area specifying data selectively include one of said entire-inside-area specifying data and said part-inside-area specifying data, and where in said embroidery-area specifying means comprises means for specifying, as said embroidery area, said part of said inside area of said each outline which is bounded by said each outline connected with said part-inside-area specifying data and is bounded by an outermost one of all inside outlines positioned inside said each outline.

33. A medium including a memory for storing a control program which is used to control a computer, the memory being accessible by the computer to process, according to the control program stored in the memory, embroidery data which are used to control a sewing machine to form stitches filling an embroidery area and thereby produce an embroidery on at least one work sheet, the control program comprising the steps of:

obtaining a plurality of sets of outline data each set of which defines a corresponding one of a plurality of outlines comprising a first outline and at least one second outline positioned inside said first outline;

obtaining, in connection with each of said outlines, a set of attribute data comprising at least one set of objective-area specifying data specifying at least one of an inside objective area and an outside objective area which are bounded by said each outline, independent of the other outlines; and specifying, as said embroidery data, at least one objective area bounded by at least one of said outlines. specifying data specifying an objective area bounded by said each outline; and specifying, as said embroidery area, an objective area bounded by at least one of said outlines.

34. A medium according to claim 33, wherein the step of obtaining said set of attribute data comprises obtaining, in connection with said each outline, said set of attribute data comprising said objective-area specifying data including outer-outline data indicating whether said each outline provides an outer outline which cooperates with one of said outlines positioned inside said each outline, to specify said objective area bounded by said each outline, and inner-outline data indicating whether said each outline provides an inner outline which cooperates with one of said outlines positioned outside said each outline, to specify said objective area.

35. A medium according to claim 34, wherein the control program further comprises a step of specifying, as said objective area bounded by said each outline, an area which is bounded by said each outline connected with said outer-outline data indicating that said each outline provides said outer outline and which is bounded by one of said outlines positioned inside said each outline and connected said inner-outline data indicating that said each outline provides said inner outline, in an order starting from an outermost one of said outlines toward an innermost one of said outlines.

36. A medium according to claim 34, wherein the control program further comprises a step of specifying, as said objective area bounded by said each outline, an area which is bounded by said each outline connected with said inner-outline data indicating that said each outline provides said inner outline and which is bounded by one of said outlines positioned outside said each outline and connected said outer-outline data indicating that said each outline provides said outer outline, in an order starting from an innermost one of said outlines toward an outermost one of said outlines.

37. A medium according to claim 33, wherein the step of obtaining said set of attribute data comprises obtaining, in connection with said each outline, said set of attribute data comprising embroidery-related data which selectively include one of embroidery-need data indicating that said objective area bounded by said each outline is specified as said embroidery area by said embroider-area specifying means, and no-embroidery data indicating that said objective area is not specified as said embroidery area.

38. A medium according to claim 33, wherein the step of obtaining said set of attribute data comprises obtaining, in connection with said each outline, said set of attribute data comprising embroidery-area specifying data as said objective-area specifying data which selectively include one of at least two sorts of data selected from the group consisting of entire-inside-area specifying data indicating that an entire inside area bounded by said each outline is specified as said embroidery area, part-inside-area specifying data indicating that a part of said inside area of said each outline is specified as said embroidery area, and no-area specifying data indicating that said inside area of said each outline is not specified as said embroidery area.

39. A medium according to claim 38, wherein said embroidery-area specifying data selectively include one of said entire-inside-area specifying data and said part-inside-area specifying data, and wherein the step of specifying said embroidery data comprises specifying, as said embroidery area, said part of said inside area of said each outline which is bounded by said each outline connected with said part-inside-area specifying data and is bounded by an outermost one of all inside outlines positioned inside said each outline.

* * * * *

UNITED STATES PATENT AND TRADEMARK OFFICE

CERTIFICATE OF CORRECTION

PATENT NO. : 5,748,480

DATED : May 5, 1998

INVENTOR(S) : Masahiro MIZUNO

It is certified that error appears in the above-indentified patent and that said Letters Patent is hereby corrected as shown below:

On the title page, in item [56] References Cited, please add:

--FOREIGN PATENT DOCUMENTS--

--1-305987 12/1989 Japan--.

Signed and Sealed this

First Day of September, 1998

*Attest:*

Bruce Lehman

BRUCE LEHMAN

*Attesting Officer*

*Commissioner of Patents and Trademarks*